US009906847B2

(12) United States Patent
Wright

(10) Patent No.: US 9,906,847 B2
(45) Date of Patent: Feb. 27, 2018

(54) SPEAKER MOUNTINGS

(76) Inventor: Doug S. Wright, Simi Valley, CA (US)

( * ) Notice: Subject to any disclaimer, the term of this patent is extended or adjusted under 35 U.S.C. 154(b) by 0 days.

(21) Appl. No.: 12/542,670

(22) Filed: Aug. 17, 2009

(65) Prior Publication Data

US 2010/0040254 A1 Feb. 18, 2010

Related U.S. Application Data

(60) Provisional application No. 61/089,546, filed on Aug. 17, 2008.

(51) Int. Cl.
*H04R 1/02* (2006.01)

(52) U.S. Cl.
CPC ..... *H04R 1/02* (2013.01); *H04R 2201/021* (2013.01)

(58) Field of Classification Search
CPC ..... H04R 1/02; H04R 1/025; H04R 2201/021
USPC ..... 381/395, 182, 87, 386; 362/285, 373; 439/391, 417
See application file for complete search history.

(56) References Cited

U.S. PATENT DOCUMENTS

| | | | | |
|---|---|---|---|---|
| 6,159,035 | A * | 12/2000 | Smith, III | 439/391 |
| 6,672,893 | B1 * | 1/2004 | Sedlecky et al. | 439/417 |
| 6,925,190 | B2 * | 8/2005 | Popken et al. | 381/395 |
| 7,676,045 | B2 * | 3/2010 | Merrey et al. | 381/87 |
| 2005/0045171 | A1 * | 3/2005 | Wright | 126/39 R |
| 2005/0078482 | A1 * | 4/2005 | Bartlett | 362/285 |
| 2006/0262545 | A1 * | 11/2006 | Piepgras et al. | 362/373 |
| 2007/0189557 | A1 * | 8/2007 | Blackmon et al. | 381/182 |
| 2007/0269074 | A1 * | 11/2007 | Broadley et al. | 381/386 |

* cited by examiner

*Primary Examiner* — Duc Nguyen
*Assistant Examiner* — Phan Le
(74) *Attorney, Agent, or Firm* — Apogee Law Group P.C.

(57) ABSTRACT

At least one embodiment of the invention provides an easy-to-install recessed speaker mounting assembly. The assembly may comprise a mounting frame, a plurality of dog fasteners, and a dog actuator ring. The mounting frame may define an opening for receiving an audio transducer, and the mounting frame may also include an outer flange around an outer perimeter of the mounting frame. The plurality of dog fasteners may be rotationally coupled to the mounting frame. The dog actuator ring may be adapted to fit within an inner perimeter of the mounting frame, wherein rotation of the dog actuator ring relative to the mounting frame causes the rotating dog fasteners to rotate and secure the mounting frame to a mounting substrate.

19 Claims, 39 Drawing Sheets

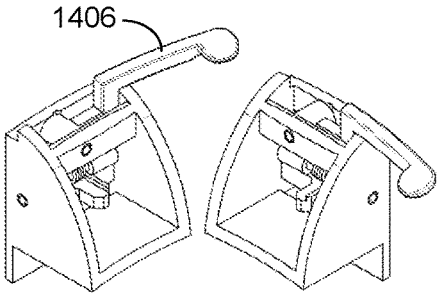
Fig. 15a
Fig. 15b
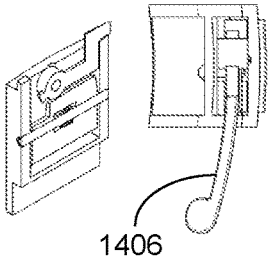
Fig. 15c
Fig. 15d
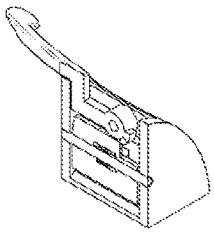
Fig. 15e
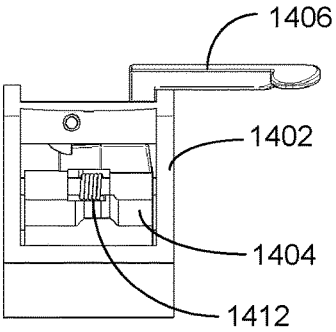
Fig. 15f
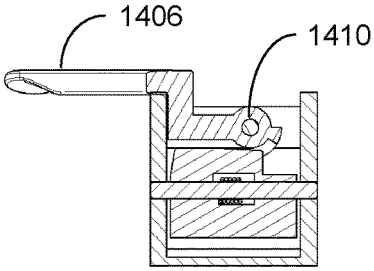
SECTION B-B
Fig. 15i
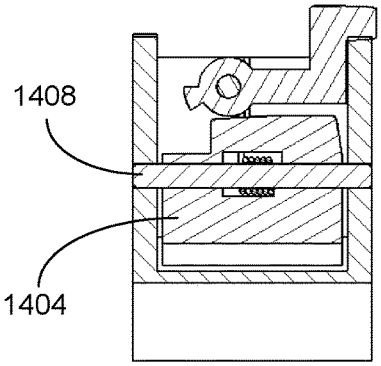
SECTION A-A
Fig. 15g
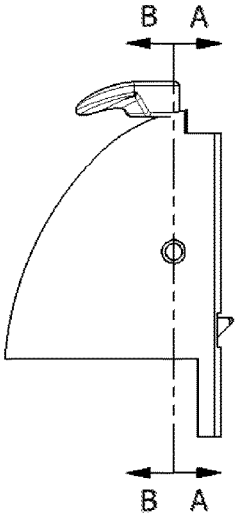
Fig. 15h

SECTION C-C

SECTION D-D

SECTION B-B

SECTION A-A

SECTION B-B

SECTION A-A

SECTION A-A

SECTION B-B

SECTION B-B

SECTION A-A

SPEAKER MOUNTINGS

CLAIM OF PRIORITY UNDER 35 U.S.C. § 119

The present Application for Patent claims priority to Provisional Application No. 61/089,546 entitled "Improvements to Speaker Mountings", by Doug S. Wright, filed Aug. 17, 2008, and expressly incorporated by reference herein.

FIELD

Various embodiments of the invention pertain to speaker mountings and assemblies that allow relatively easy installation.

BACKGROUND

In order to save space and/or for aesthetic reasons it is often desirable to mount speakers within a wall or ceiling cavity or recess. A mounting assembly is commonly used to secure the speakers to the wall or ceiling. Various types of frames and fasteners are often used for the purpose of securing the speaker to the wall or ceiling cavities.

A speaker mounted in a wall or ceiling using a conventional frame assembly typically has a sound dispersion axis that is perpendicular to the plane formed by the mounting surface, e.g., wall or ceiling. However, speakers with sound dispersion axes directed at the floor or an opposing wall often do not provide an environment with optimum sound quality. Thus, when installing one or more speakers in a room, it is often desirable to adjust the angle of one or more of the speakers to provide a better sound quality or effect.

It is often necessary or desirable to adjust the direction in which, for instance, a ceiling-mounted speaker radiates sound. For example, when providing a surround sound effect with one or more recessed speakers, the sound dispersion axis of the speakers is adjusted to provide optimum sound quality at a given point or location in the room.

However, conventional speaker mounting systems make it difficult to adjust the sound dispersion axis of a speaker to provide an optimum sound quality. For example, many conventional speakers are fixedly mounted in a wall or ceiling recess and cannot be adjusted. Additionally, even when adjustments to the speakers are possible, prior art mounting mechanisms are typically restricted to a limited number of positions. This may not always permit directing a speaker's sound dispersion axis to obtain the best sound quality in a particular room or environment.

Even when the speakers can be adjusted, they are often difficult and/or cumbersome to readjust at a later time. This may be necessary, for instance, in a surround sound speaker configuration that has been setup for optimal sound quality at a first location and now the optimal sound quality is desired at a second location. Such is the case, for example, when a couch is moved from a first location to a second location in a room. Readjusting conventional speakers is typically requires removal and reinstallation of the speaker and/or speaker mounting assembly which is undesirable and costly.

Audio devices, such as speakers, woofers and/or tweeters, are often mounted within a wall or ceiling cavity or recess. Various types of frames and/or fasteners are used for the purpose of securing the audio devices within a wall or ceiling cavity.

Mounting such audio devices within a recessed cavity poses several problems. For instance, mounting an audio device inside a ceiling cavity may prevent the sound emitted from such device from directly reaching listeners. Adjusting a conventional mounting mechanism to position the audio device at the correct depth, direction, and angle may be burdensome or impossible. That is, it may not be possible to direct the sound dispersion axis of the recessed audio device to reach a listener directly. As a result sound quality may be affected.

When mounting a tweeter, for instance, the tweeter is typically fixedly secured in a mounting base. The mounting base may then be secured to a supporting mechanism within a ceiling cavity, for instance. However, conventional mounting mechanisms do not permit to easily adjust the position (e.g., depth, direction, and angle) of the tweeter.

Additionally, conventional mounting systems and fasteners are typically cumbersome and time-consuming to install, take many steps to mount, and require the use of several tools. This increases the cost of installation and deployment of, for instance, recessed speakers, lights, or exhaust fans.

DETAILED DESCRIPTION

In the following description numerous specific details are set forth in order to provide a thorough understanding of the invention. However, one skilled in the art would recognize that the invention may be practiced without these specific details. In other instances, well known methods, procedures, and/or components have not been described in detail so as not to unnecessarily obscure aspects of the invention.

The following description, certain terminology is used to describe certain features of one or more embodiments of the invention. The term "audio device" refers to any type of sound-generating device, including a speaker, loudspeaker, audio speaker, woofer, subwoofer, tweeter, and/or acoustic transducer.

A first aspect of the invention provides a recessed speaker assembly that can be mounted within a cavity and coupled to a mounting substrate by manually turning a single Dog Actuator Ring that causes a plurality of Rotating Dogs to rotate and secure the recessed speaker assembly. The advantage of this recessed speaker assembly is that a single turning motion can serve to couple the assembly within a cavity with the need for tools.

A second aspect of the invention relates to a Baffle that is pushed into the recessed speaker assembly to secure the Baffle and an audio transducer (speaker) to the recessed speaker assembly. The Baffle includes a plurality of Latch Assemblies that automatically engage the recessed speaker assembly. Additionally, unique electrical contacts are used so that the audio transducer is electrically coupled to the recessed speaker assembly without having to manually splice and/or attach wires for the audio transducer.

A third aspect of the invention relates to a wire connection device that provides an easy to install, secure and reliable electrical connection. The electrical wires are inserted into a Wire Guide which retains the wires in place. The Wire Guide is then inserted into a Connector Base, causing the ends of the wires to be impaled by a Needle Wire Penetrator that electrically couples the wires to terminals at an opposite end of the wire connector device. Additionally, the wire connector device may include an integrated system to release or inject grease into the connection chamber, to thereby seal the electrical connection from environmental effects.

A fourth aspect of the invention relates

Zero Tool, Thin Wall, Frame Mounting System

Figure 1:
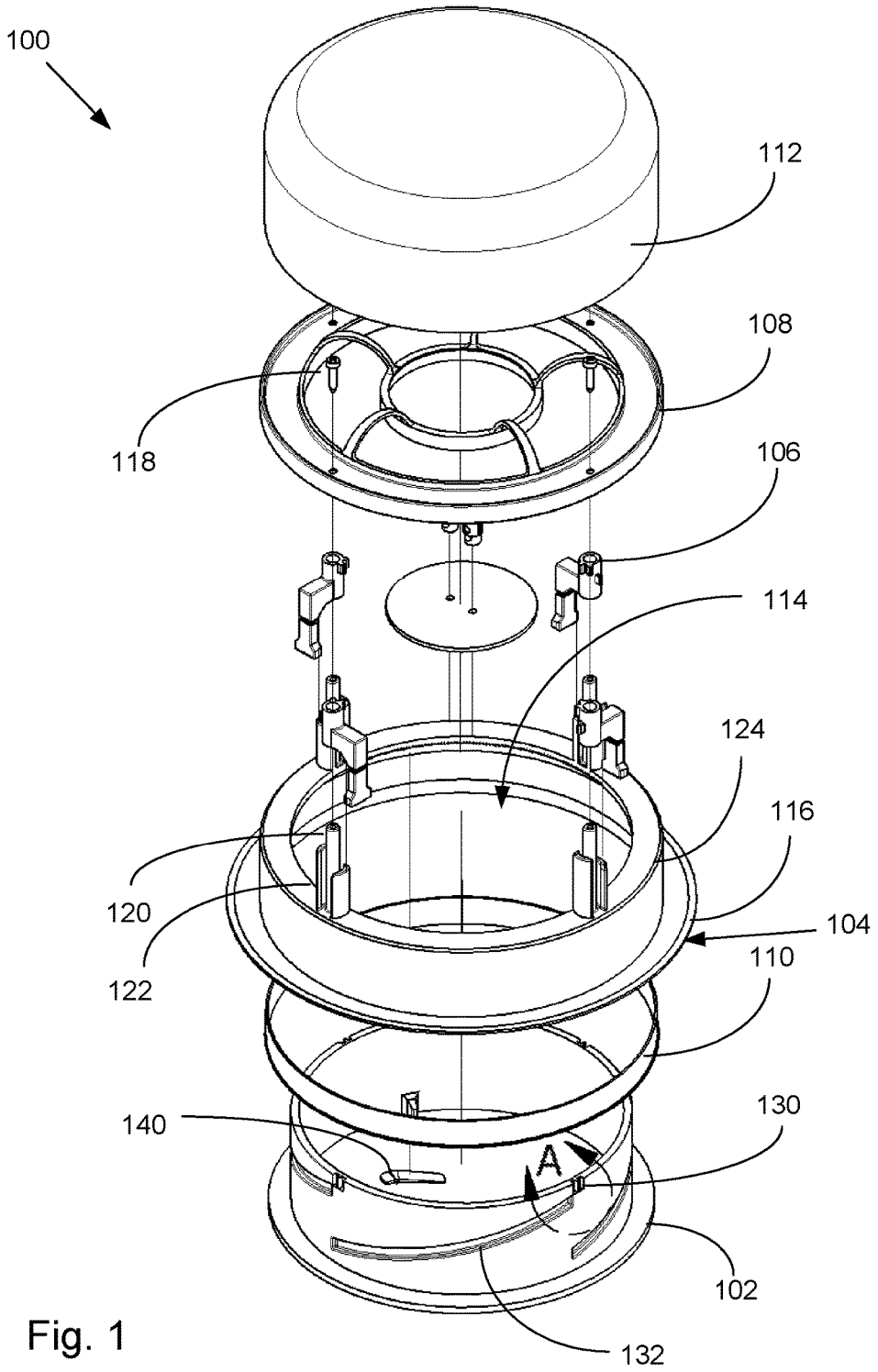
FIG. 1 illustrates a recessed speaker assembly 100 that can be latched and secured without the need of tools other than the human hand.
Figure 2:
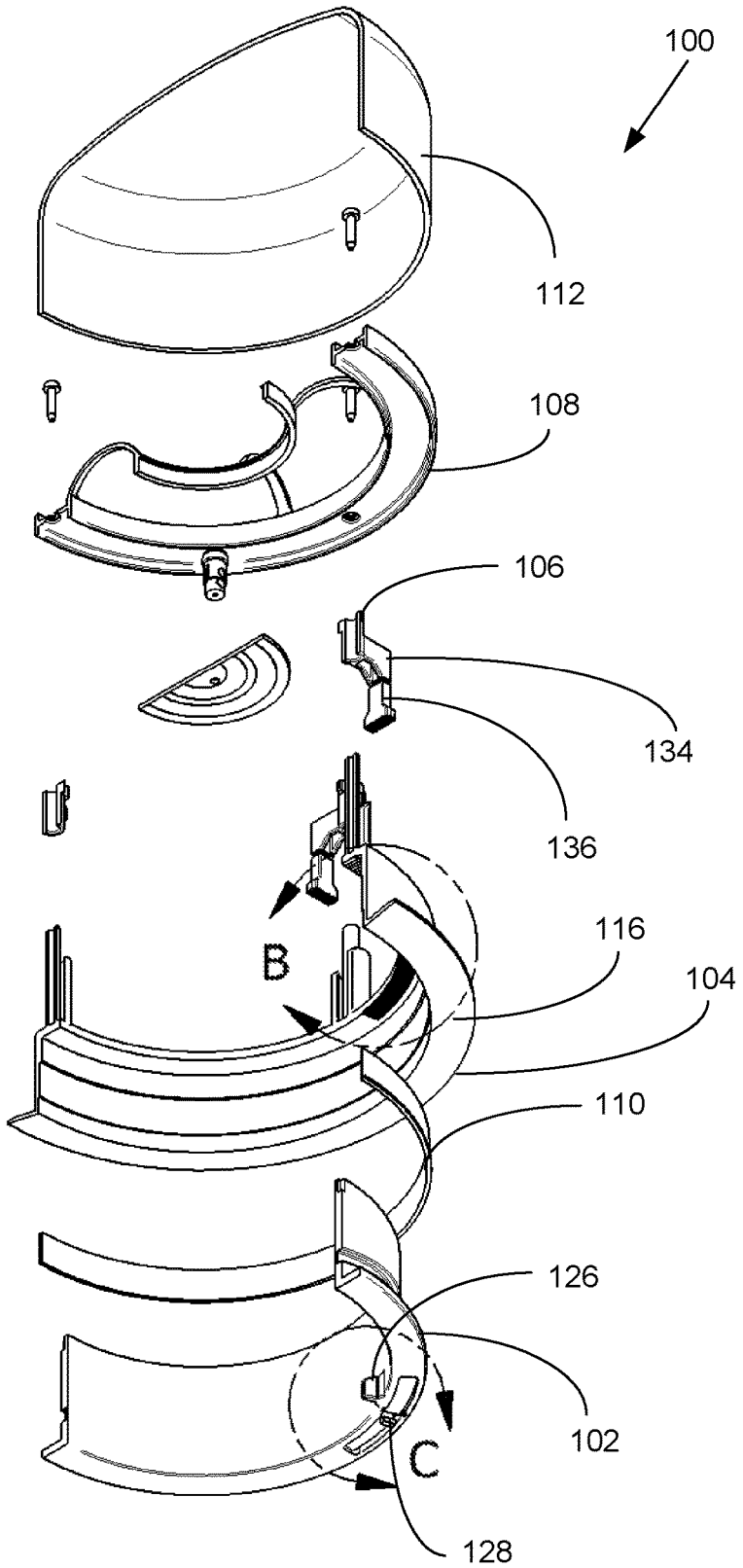
FIG. 2 illustrates a cross-sectional view of the recessed speaker assembly of FIG. 1.

FIG. 1 illustrates a recessed speaker assembly 100 that can be latched and secured without the need of tools other than the human hand. FIG. 2 illustrates a cross-sectional view of the recessed speaker assembly of FIG. 1. The recessed speaker assembly 100 also improves on the prior art in that it does not require additional depth behind a mounting wall or ceiling to function and is therefore suitable for thin wall cavity applications (like certain marine applications). For example, in various applications the recessed speaker assembly 100 may have a total thickness of between 4 inches and 8 inches. The recessed speaker assembly may include a Mounting Frame 104 that actuates with no more than a one-quarter rotation of a Dog Actuator Ring 102 and is held firmly in place with a ratcheting latch that accommodates varying mounting substrate thicknesses (e.g., the substrate to which the recessed speaker assembly 100 is mounted and coupled). Depending on the overall system depth limitation, the recessed speaker assembly 100 can accommodate a great range of mounting surface thicknesses.

In one example, the recessed speaker assembly 100 may comprise a Dog Actuator Ring 102, a Latch Trap Ring 110, a Mounting Frame 104, a plurality of Rotating Dogs 106, a Retaining Ring 108, and Back Can 112. The Mounting Frame 104 may defined as substantially circular ring 124 defining a central opening 114 and having a perimeter flange 116 that serves to rest against the exterior surface of the mounting substrate. The Dog Actuator Ring 102 is inserted within the central opening 114 of the Mounting Frame 104 with the Latch Trap Ring 110 between the Dog Actuator Ring 102 and the Mounting Frame 104. The Retaining Ring 108 may be fixedly attached to the Mounting Frame 104 by fasteners 118. The Back Can 112 may fit over the Retaining Ring 108 to protect a speaker and/or other components housed within the recessed speaker assembly 100.

The attachment system to fasten or couple the recessed speaker assembly 100 to a mounting surface, may be comprised of four major components—the Mounting Frame 104, the Dog Actuator Ring 102, the plurality of Rotating Dogs 106 and the Retaining Ring 108. The Mounting Frame 104 is sized to fit through an opening of the mounting surface while the perimeter flange 116 rests against the exterior surface f the mounting substrate. Note that rather than suing screws (as employed by prior art dogs), the recessed speaker assembly 100 uses a plurality of Dog Guide Pins 120 that center and guide a corresponding Rotating Dog 106 that rotates about the Dog Guide Pins 120. A Dog Tower 122 provides for initial dog placement and rotational constraints.

The interaction between the Dog Actuator Ring 102 and the Rotating Dogs 106 is now described. When in the pre-installation position, the Rotating Dogs 106 are in a "retracted" position that allows the Mounting Frame Assembly to be installed through a precut opening in the mounting substrate. That is, the Rotating Dogs 106 are turned or positioned such that they do not obstruct the circular ring 124 from passing through the opening in the mounting substrate. Once the perimeter flange 116 is pressed against the exterior surface of the mounting substrate, the installer rotates the Dog Actuator Ring 102, assisted by engaging his/her fingers against the Dog Actuator Rotation Assist Flange 126; which in turn causes the simultaneous rotation of the plurality of Rotating Dogs 106 via an array of toothed Dog Actuator Gears 130 molded into the exterior edge of the Dog Actuator Ring 102. This action rotates the plurality of Rotating Dogs 106 into a position approximately ninety (90) degrees from their pre-installation position and positions the Spiral Ramp Engagement Pins 402 (FIG. 4) of the Rotating Dog 106 into the Spiral Ramp 132 of the Dog Actuator Ring 102. The continued rotation of the Dog Actuator Ring 102 causes the Rotating Dog 106 to simultaneously move down the Dog Tower 122 channel toward the interior surface of the mounting substrate to which the recessed speaker assembly 100 is being mounted. Simultaneous with these actions, the Ratchet Engagement Flange 1004 (FIG. 10) of the Dog Actuator Ring 102 interfaces with the Ratchet Teeth 504 (FIG. 5) of the Mounting Frame 104. The Dog Actuator Ring 102 is rotated (e.g., clockwise) until the recessed speaker assembly 100 is secured by the mounting substrate. The Ratchet Teeth 504 do not allow a loosening of the recessed speaker assembly 100 since the teeth 504 engage the Ratchet Engagement Flange 1004. The Ratchet Engagement Flange 1004 is on the opposite side of the Ratchet Release Flange 128. By pressing on a first end of the Ratchet Release Lever 140, a second end of the Ratchet Release Lever 140 pulls, flexes or lifts the Ratchet Release Flange 128 thereby causing the Ratchet Engagement Flange 1004 to disengage from the Ratchet Teeth 504. After the Ratchet Engagement Flange 1004 (FIG. 10) is released or disengaged from the Ratchet Teeth 504, the recessed speaker assembly 100 can be removed by continuing to rotate the Dog Actuator Ring 102 (e.g., counterclockwise).

Simultaneously pressing the Ratchet Release Lever 140 and counter-clockwise rotating the Dog Actuator Ring 102 via finger pressure on the Dog Actuator Rotation Assist Flange 126 allows the ratchet to release (i.e., the Ratchet Engagement Flange 1004 disengages from the Ratchet Teeth 504) and the Dog Actuator Ring 102 to rotate. This action lifts the Rotating Dog 106 back up the Dog Tower 122 channels, disengaging the recessed speaker assembly from the mounting substrate. Fully counter-rotating the Dog Actuator Ring 102 causes the Rotating Dogs 106 to reengage the gear interface (e.g., the Dog Gears 410 engaged to the Dog Actuator Gear 130) between the Rotating Dogs 106 and the Dog Actuator Ring 102 thereby rotating the Rotating Dogs 106 back into their pre-installation position, and enabling the removal of the Mounting Frame 104 from the mounting substrate.

Figure 3:
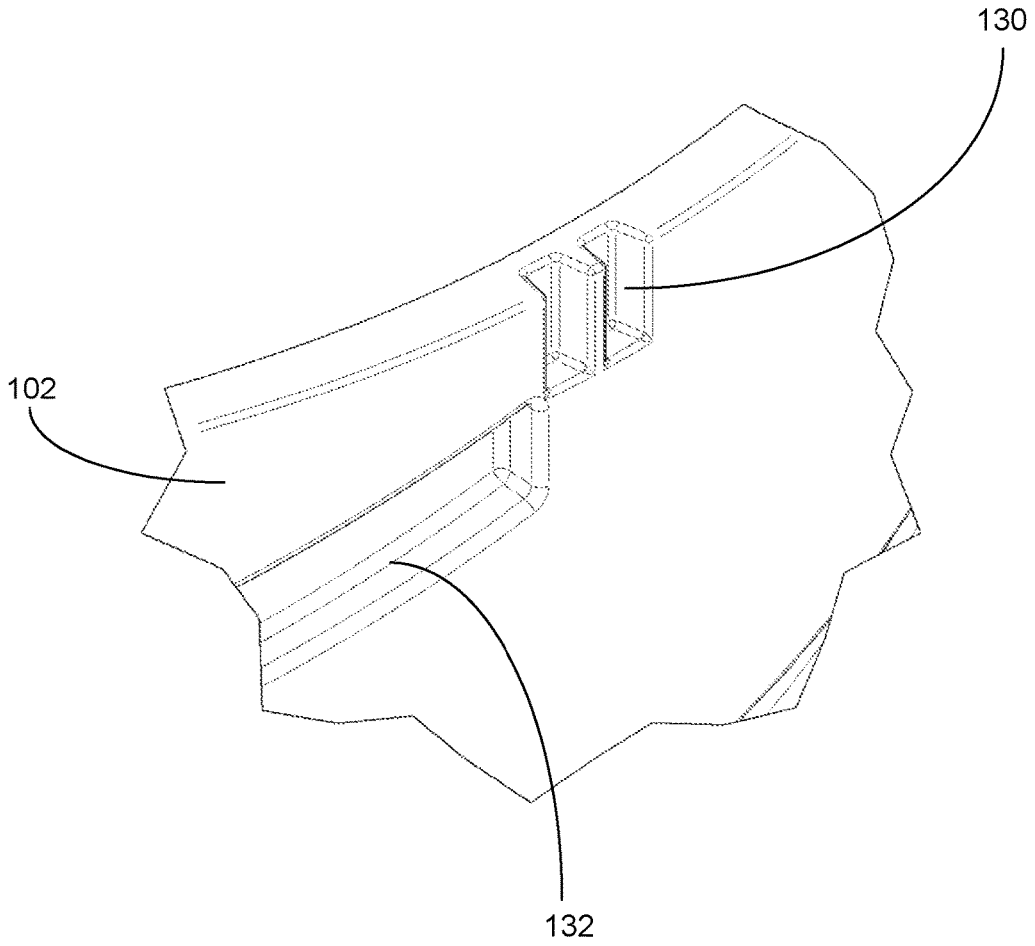
FIG. 3 illustrates a close-up view of a Dog Actuator Ring of the recessed speaker assembly including the Dog Actuator Gears and the Spiral Ramp.

FIG. 3 illustrates a close-up view of the Dog Actuator Ring 102 including the Dog Actuator Gears 130 and the Spiral Ramp 132.

Figure 4:
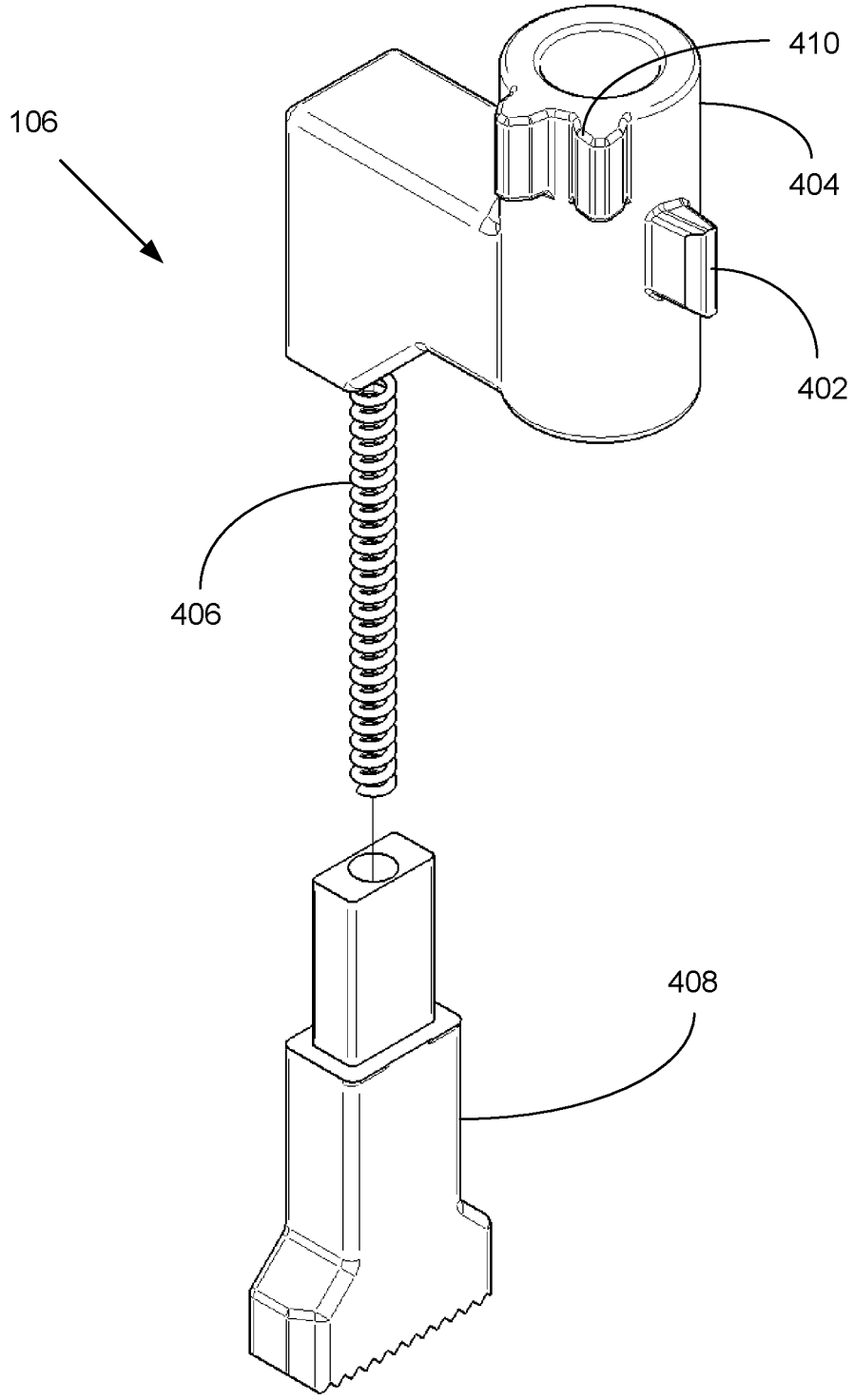
FIG. 4 illustrates an example of a Rotating Dog.

FIG. 4 illustrates an example of a Rotating Dog. To accommodate mechanical variations in the recessed speaker assembly 100 and possible small variations in mounting substrate thicknesses, the Rotating Dogs 106 may be comprised of three components: a Dog Shaft 404, a Dog Tensioning Spring 406 and a Dog Foot 408. The Rotating Dog 106 also includes Dog Gears 410 to engage the Dog Actuator Gear 130. These components, in concert, accommodate the aforementioned variations and provide equal retention forces on the mounting substrate.

Figure 5:
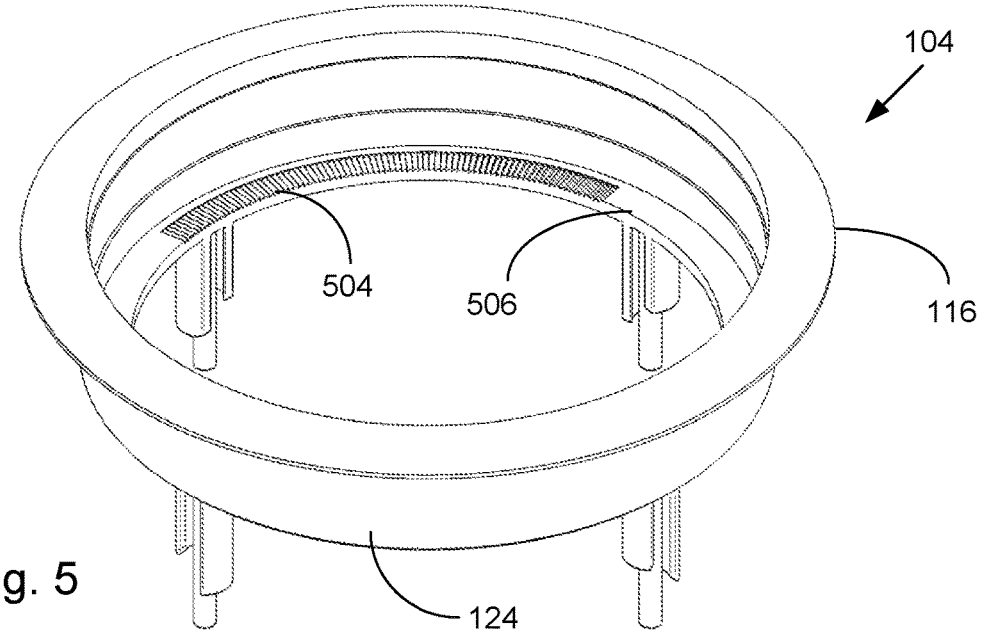
FIGS. 5 and 6 illustrate an example of the Mounting Frame.
Figure 6:
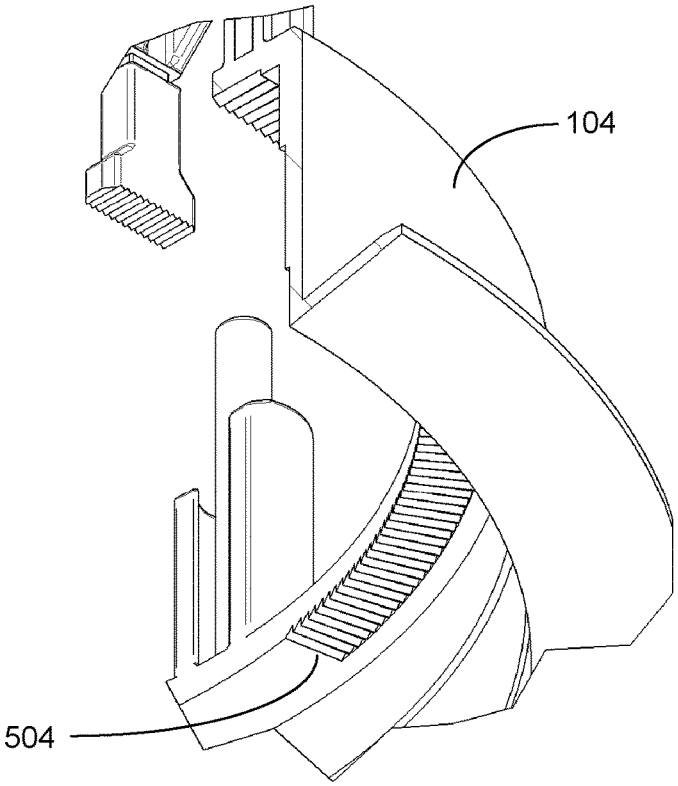

FIGS. 5 and 6 illustrate an example of the Mounting Frame 104. It can be appreciated that the Mounting Frame 104 includes an external flange 116 at one end of the ring and an internal flange 506 at an opposite end of the ring. The internal flange 506 includes a partial segment or arc of Ratchet Teeth 504 that serve to prevent the Dog Actuator Ring 102 from rotating once it is secured in place.

Figure 7:
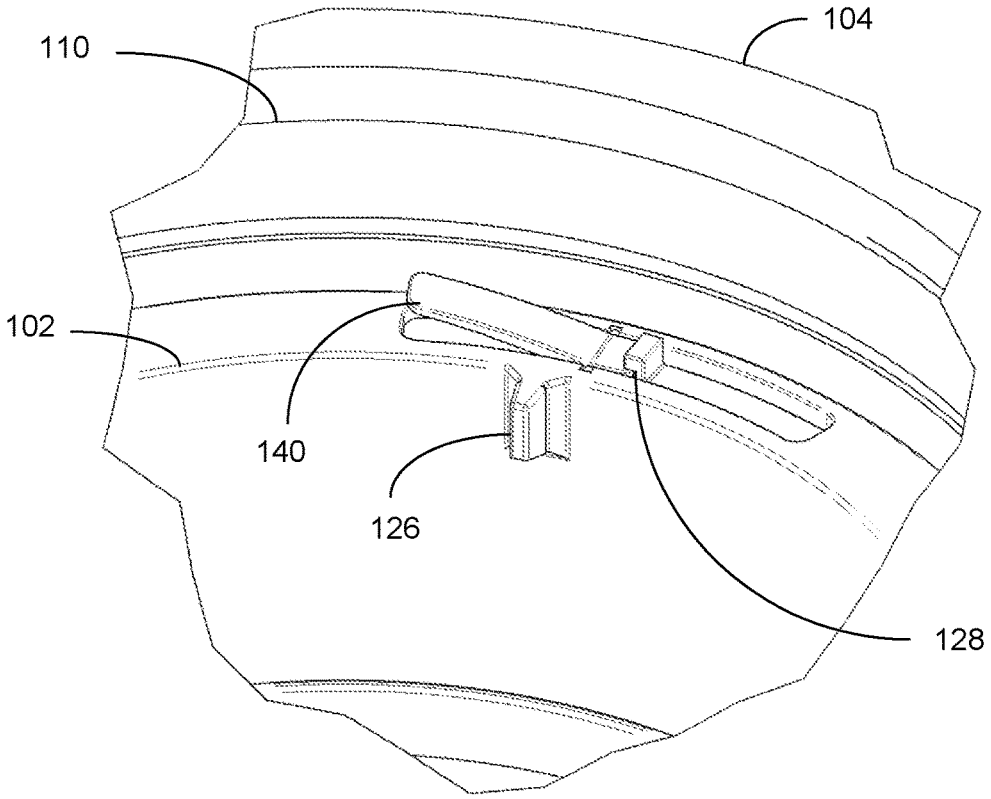
FIGS. 7 and 8 illustrate a close up of how the Dog Actuator Ring is secured to the Mounting Frame.
Figure 8:
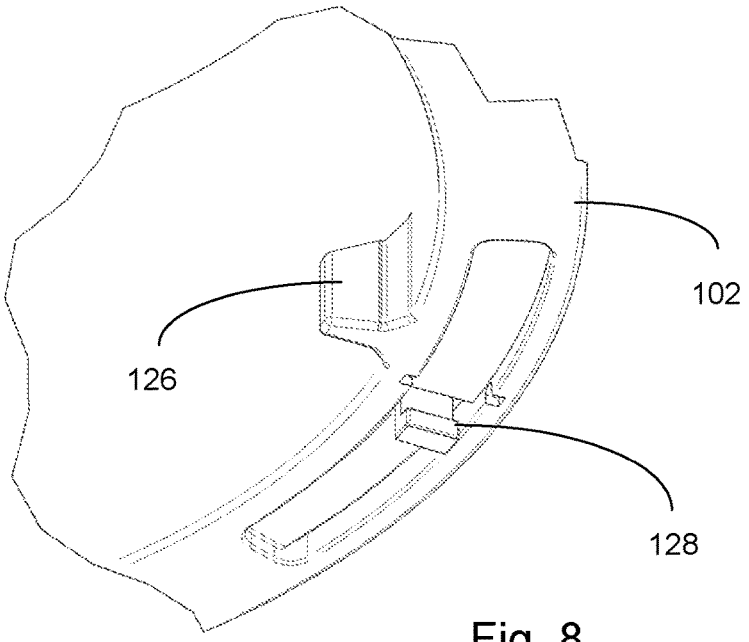

FIGS. 7 and 8 illustrate a close up of how the Dog Actuator Ring 102 is secured to the Mounting Frame 104.

Figure 9:
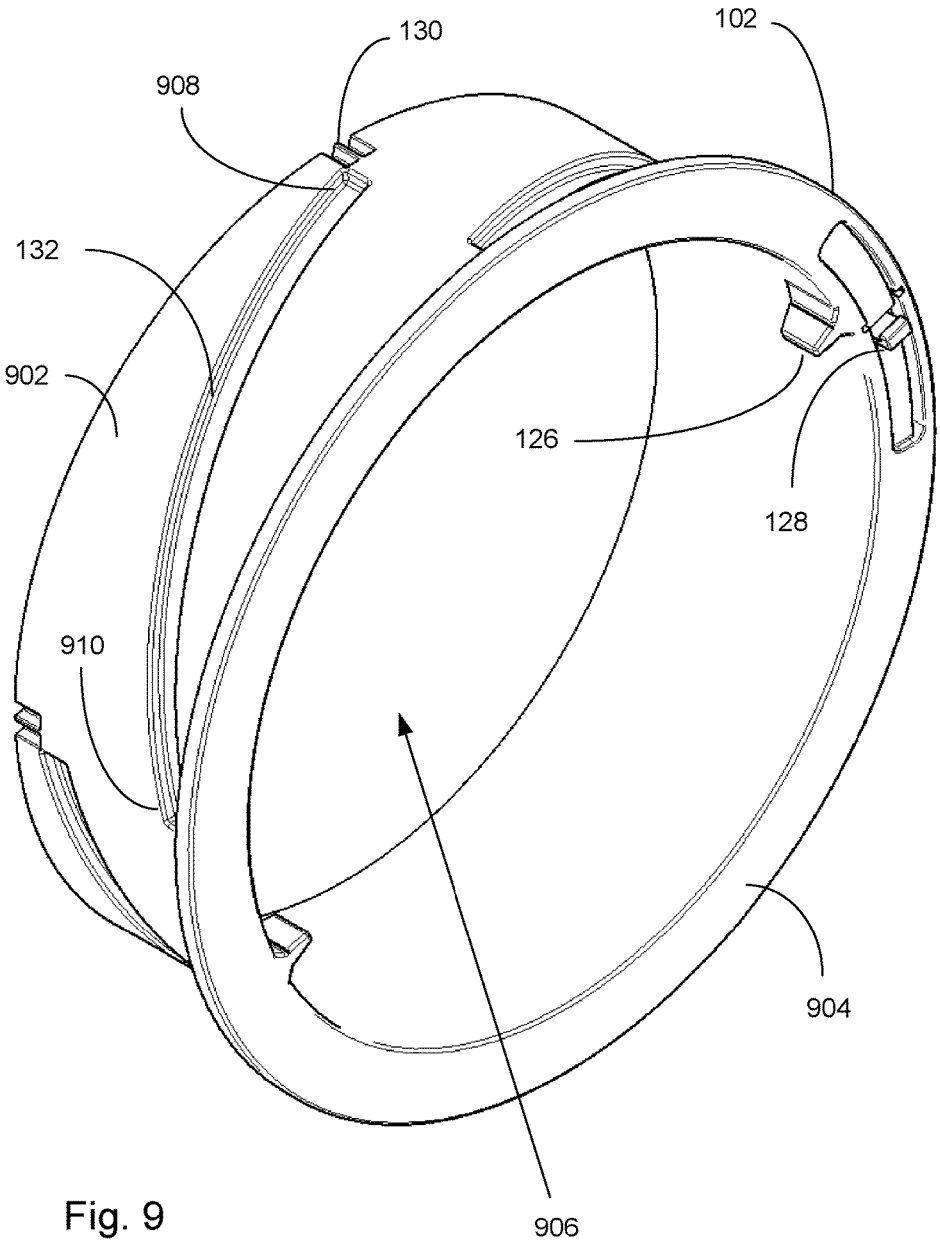
FIGS. 9 and 10 illustrate perspective views of the Dog Actuator Ring.
Figure 10:
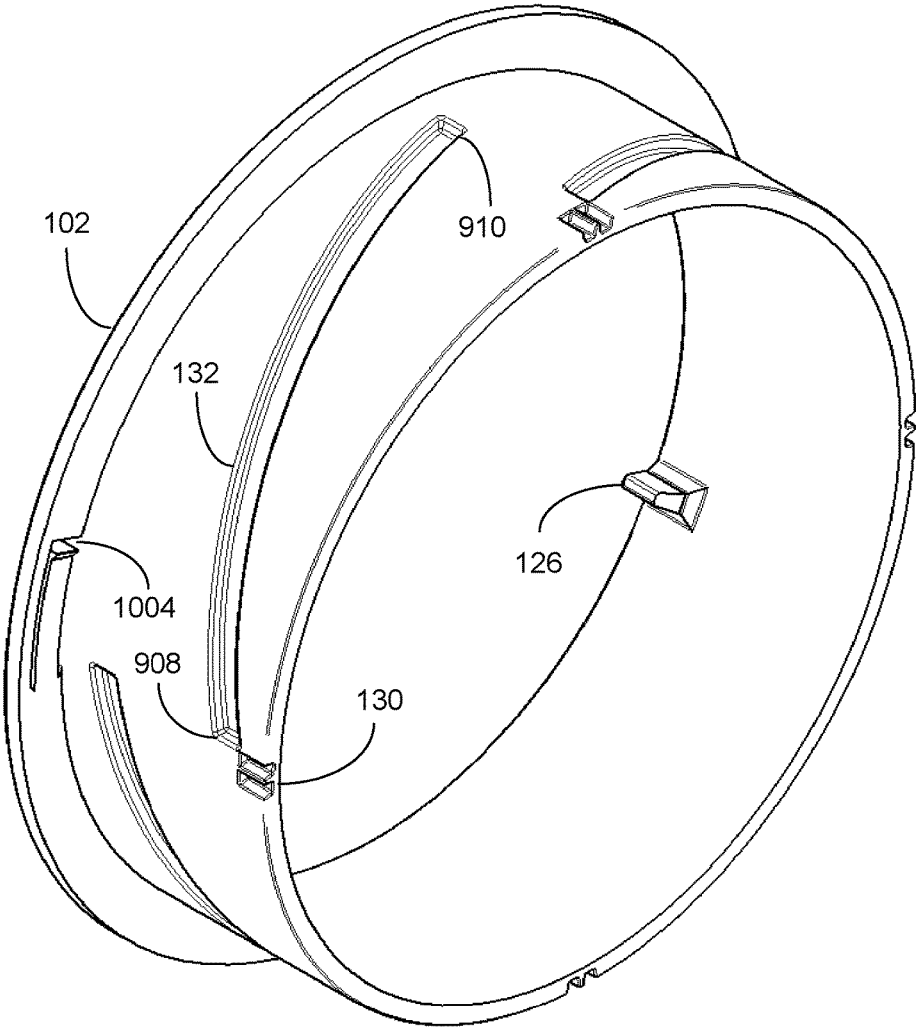
Figure 22:
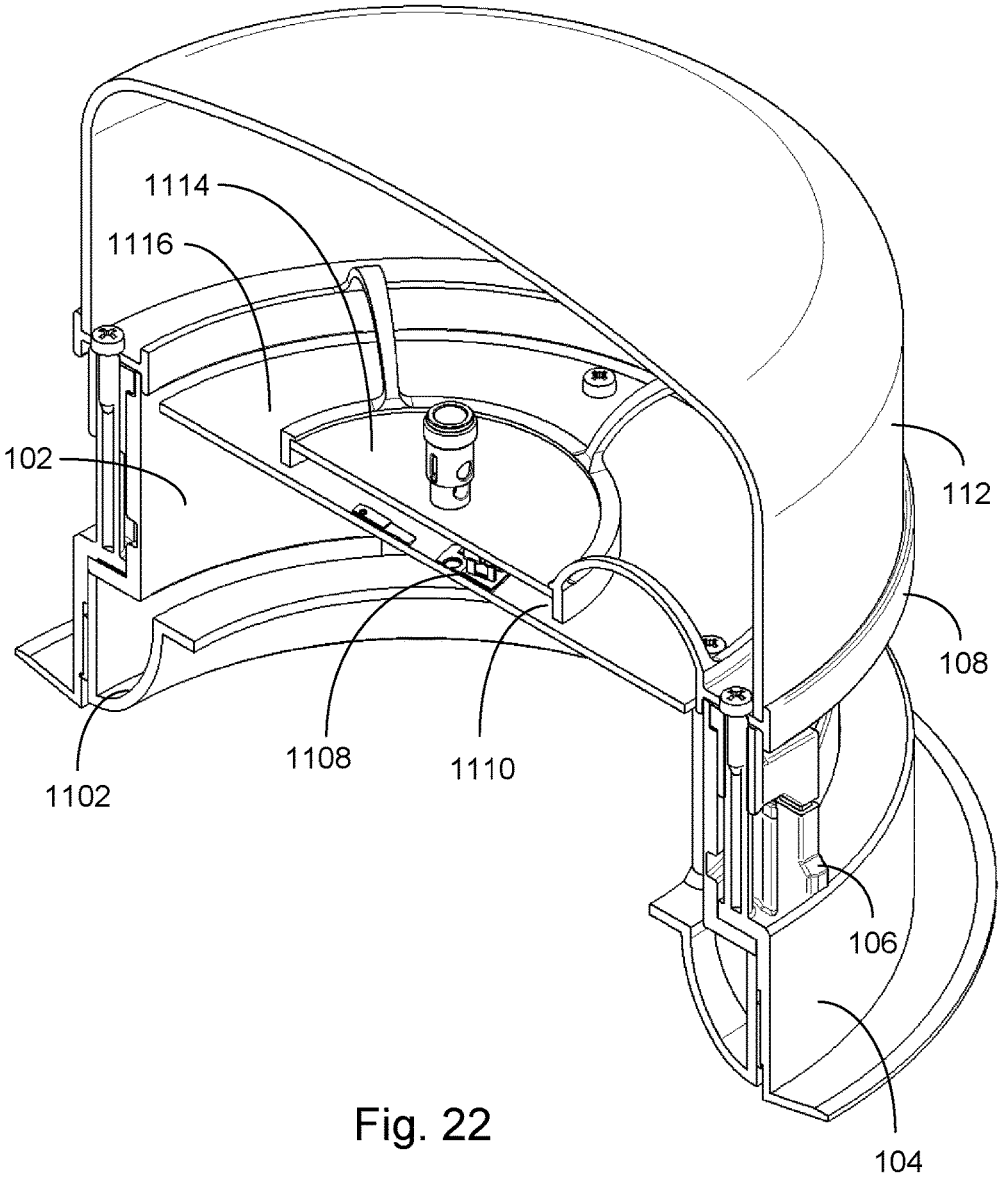
FIGS. 22 and 23 illustrate an example of an assembled speaker assembly.
Figure 23:
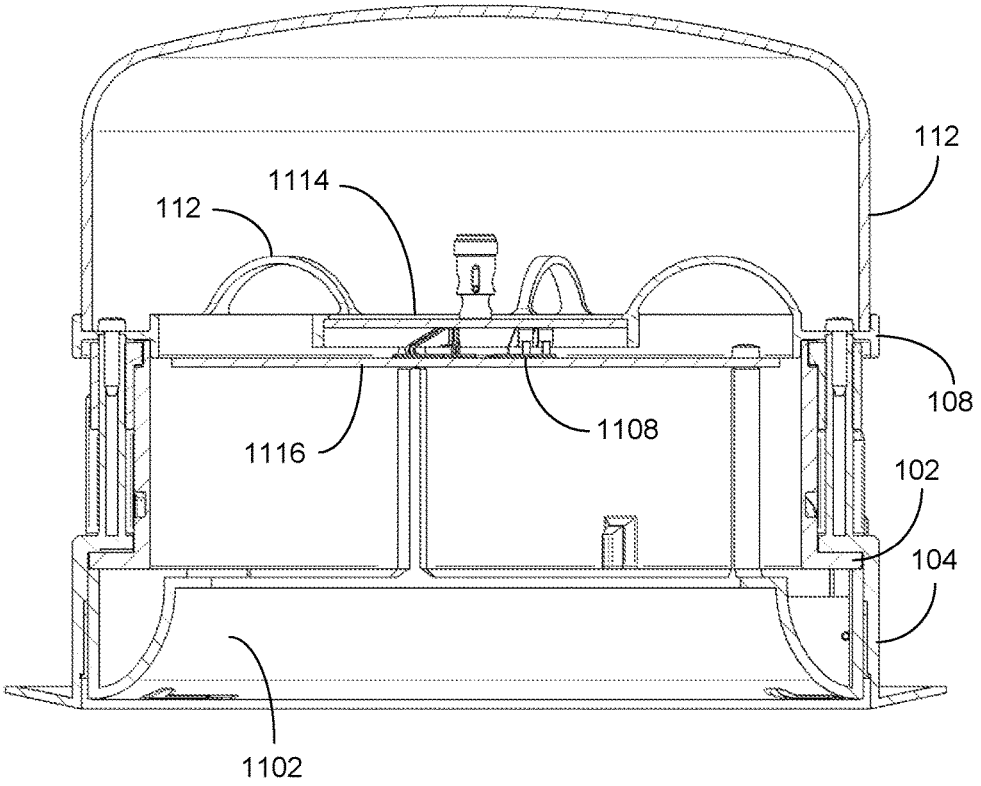
Figure 24:
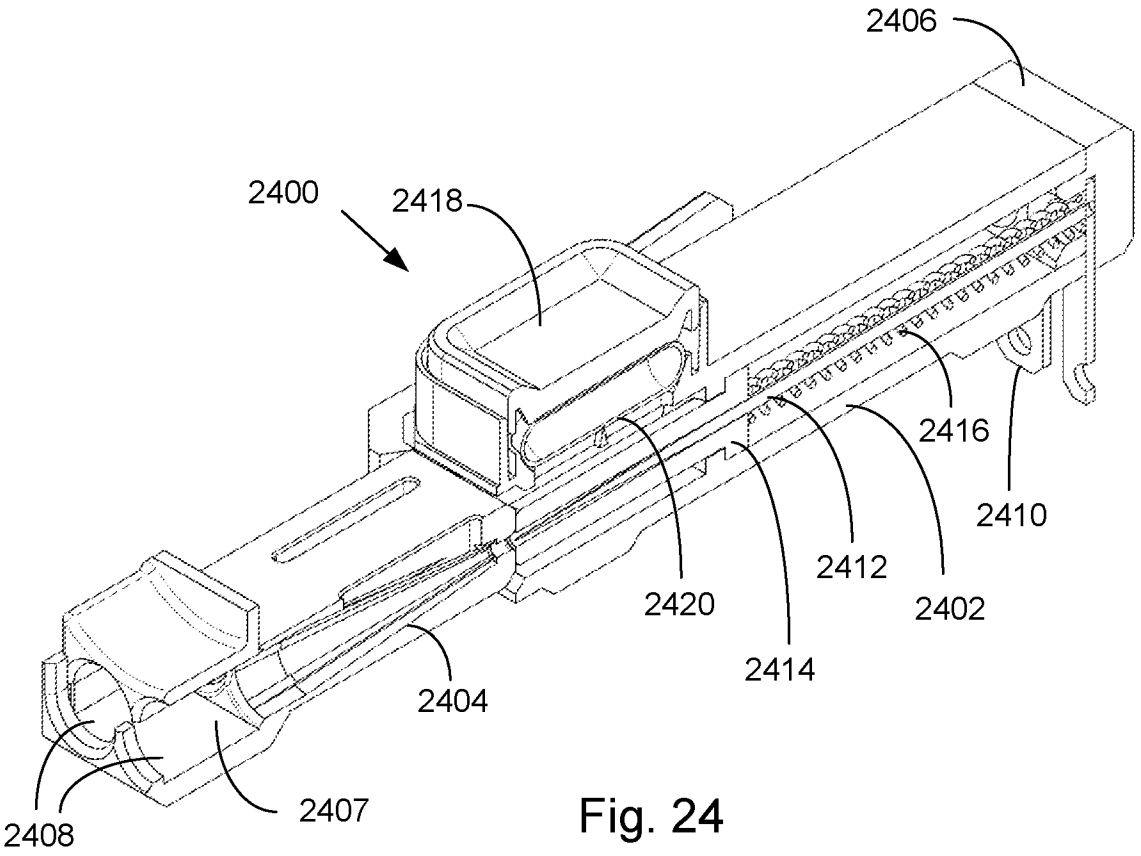
FIGS. 24, 25, 26, and 27 illustrate various perspective, exploded, and/or cross-sectional views of one example of a wire terminating or connection device.
Figure 25:
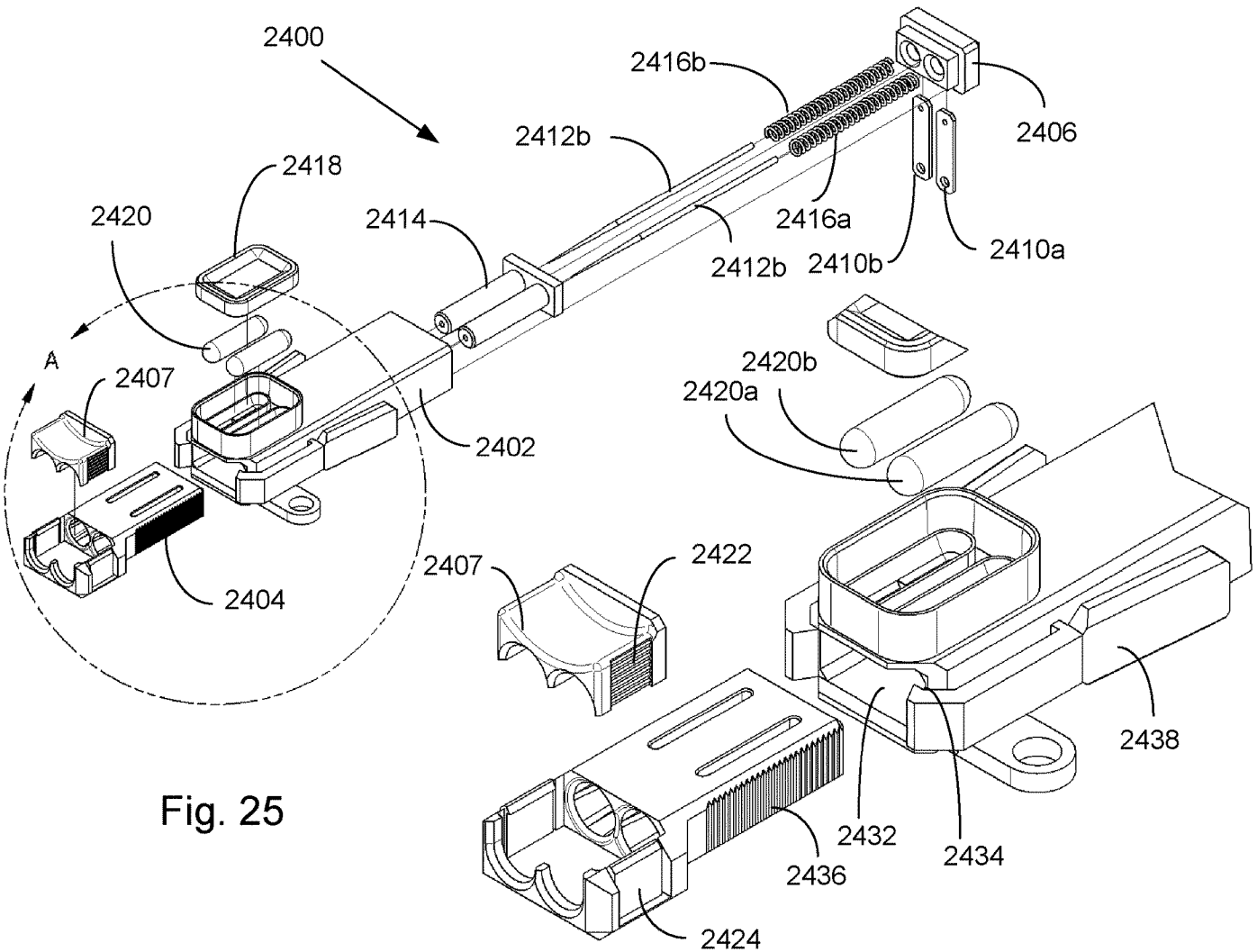
Figure 26:
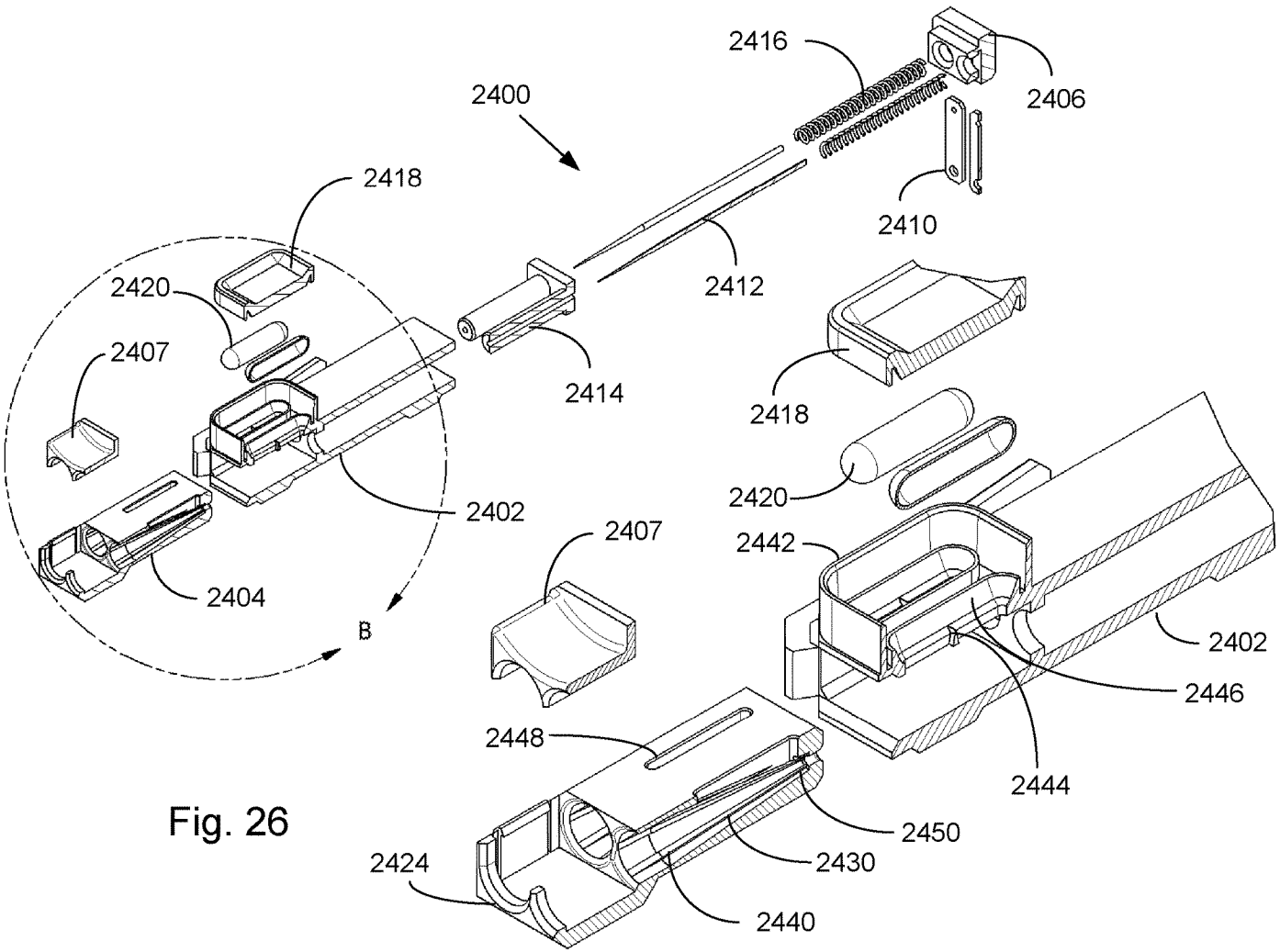
Figure 27:
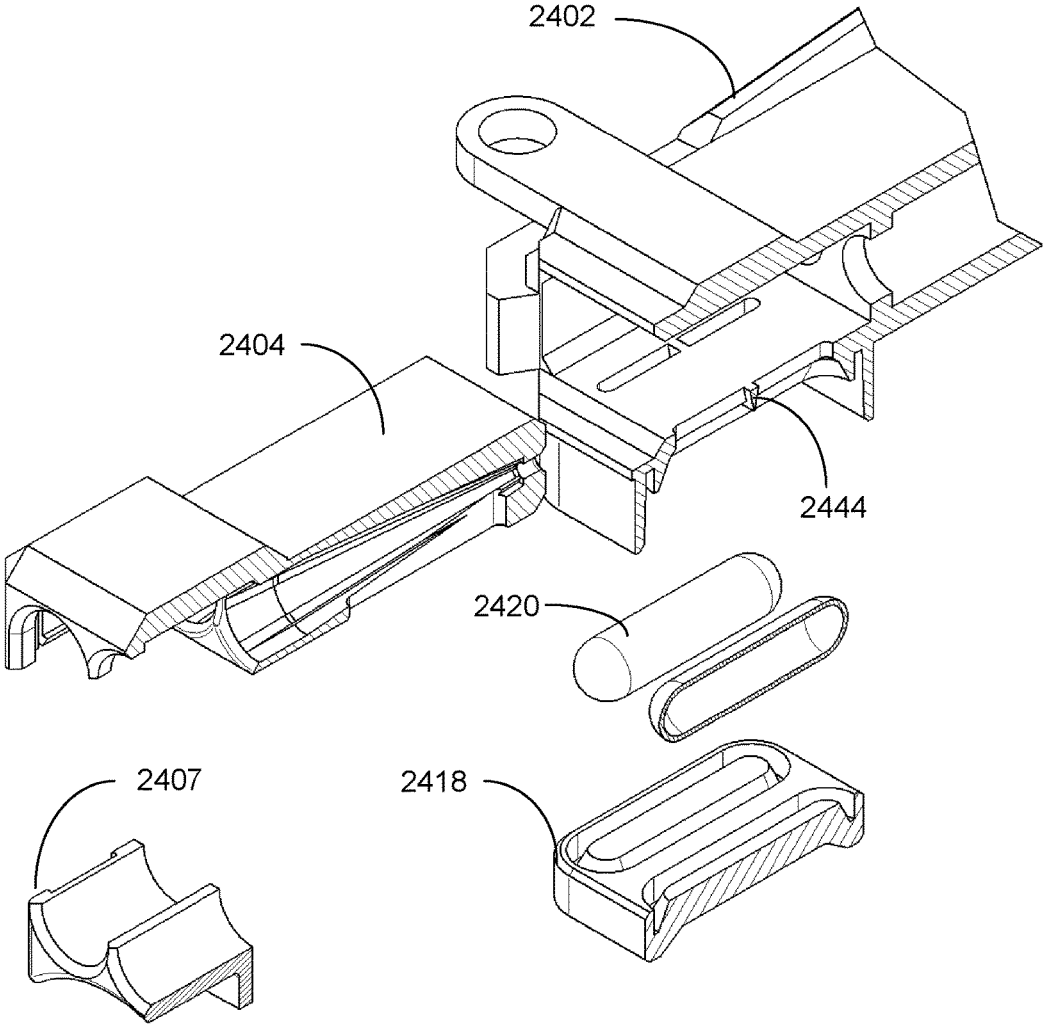
Figure 28A:
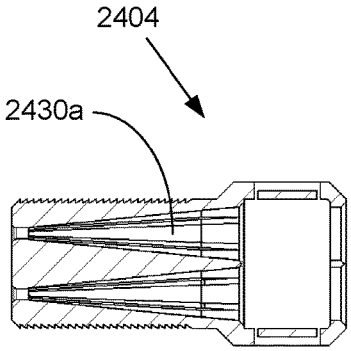
FIG. 28 (comprising FIGS. 28*a-i*) illustrates various views of one example of a Wire Guide.
Figure 28B:
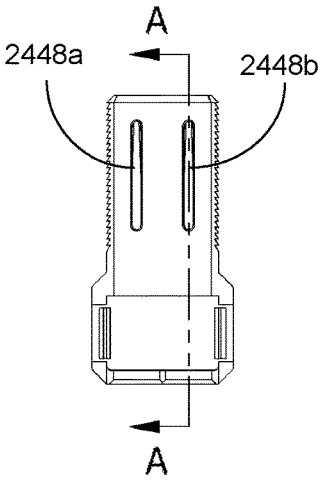
Figure 28C:
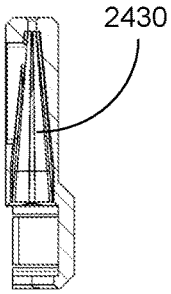
Figure 28D:
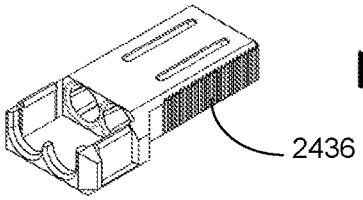
Figure 28E:
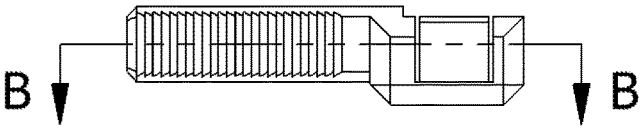
Figure 28F:
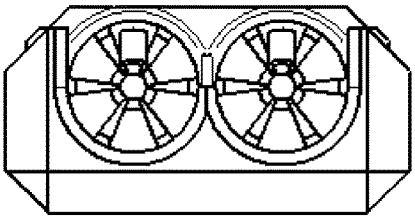
Figure 28G:
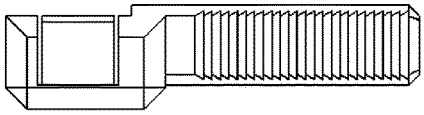
Figure 28H:
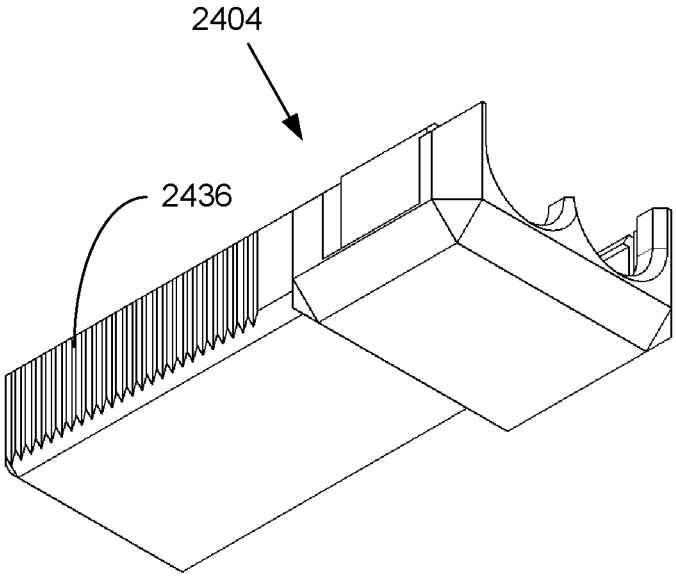
Figure 28I:
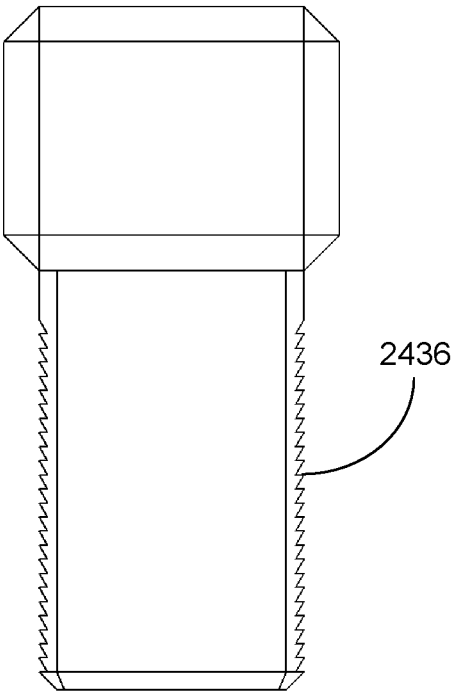
Figure 29A:
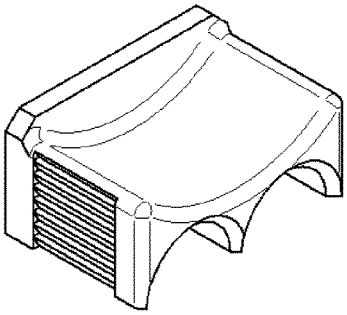
FIG. 29 (comprising FIGS. 29*a-g*) illustrates various views of one example of a Wire Retainer.
Figure 29B:
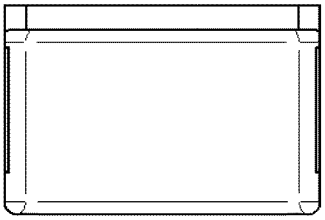
Figure 29C:
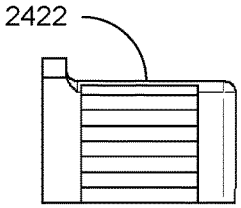
Figure 29D:
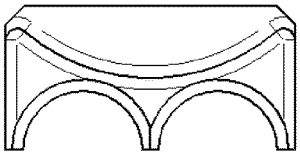
Figure 29E:
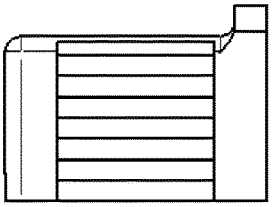
Figure 29F:
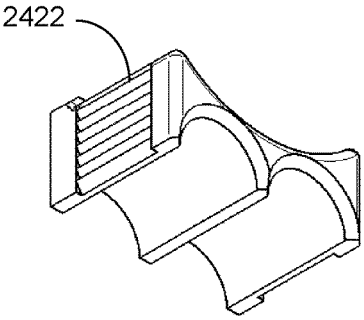
Figure 29G:
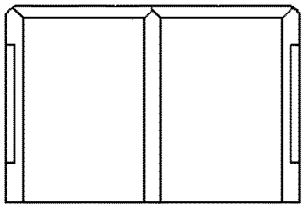
Figure 30A:
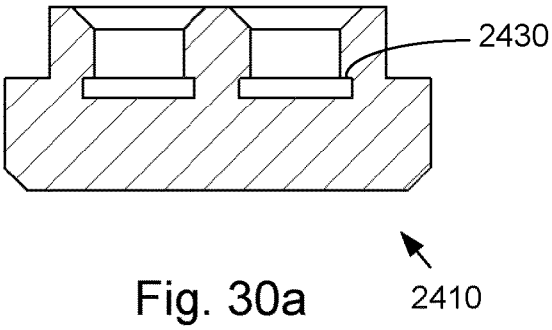
FIG. 30 (comprising FIGS. 30*a-g*) illustrates various views of one example of a Back Cover.
Figure 30E:
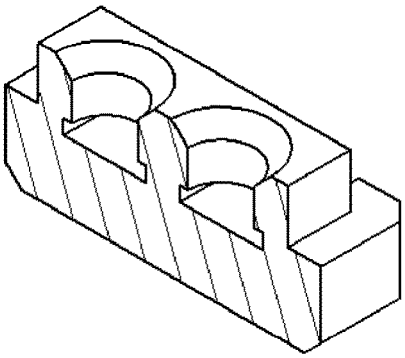
Figure 30B:
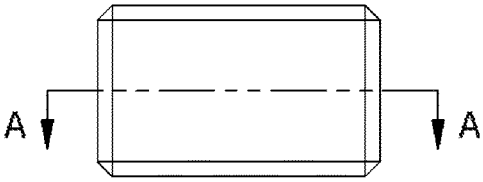
Figure 30F:
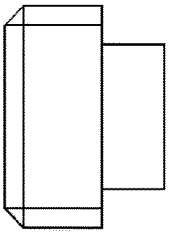
Figure 30C:
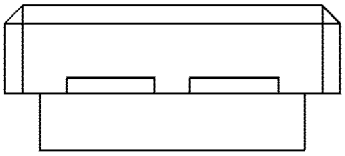
Figure 30G:
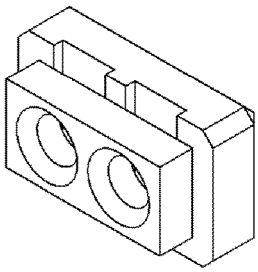
Figure 30D:
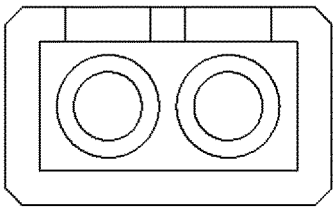
Figure 31A:
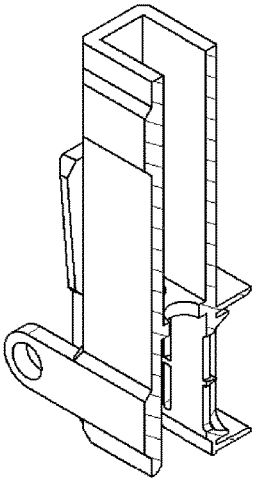
FIG. 31 (comprising FIGS. 31*a-j*) illustrates various views of one example of a Connector Base.
Figure 31B:
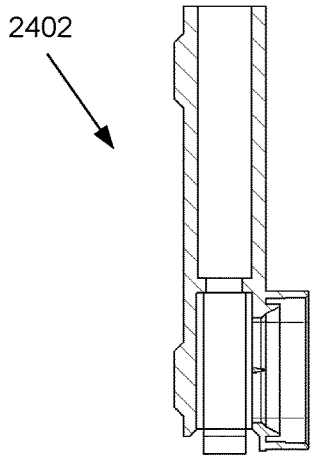
Figure 31C:
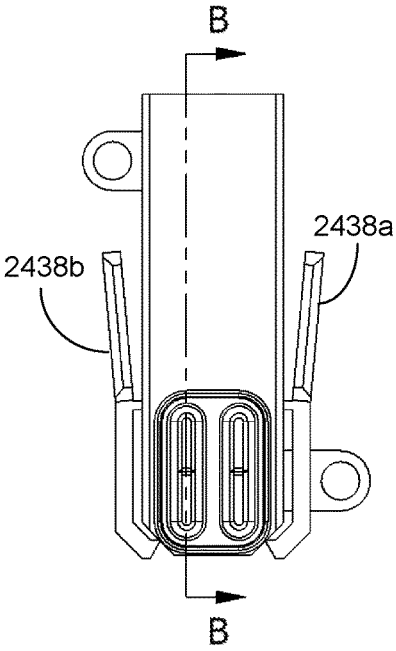
Figure 31D:
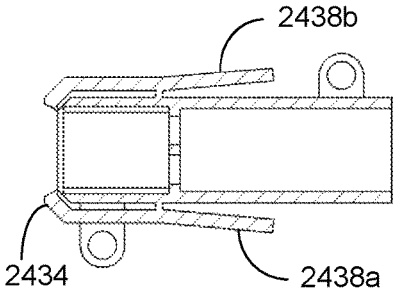
Figure 31F:
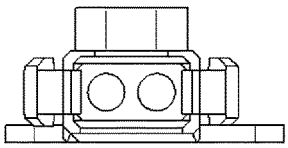
Figure 31E:
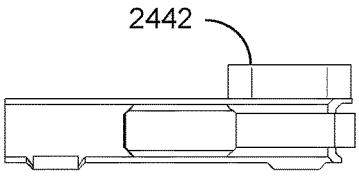
Figure 31G:
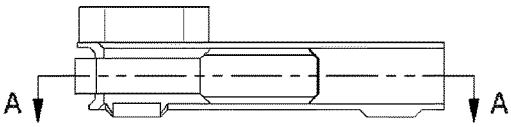
Figure 31H:
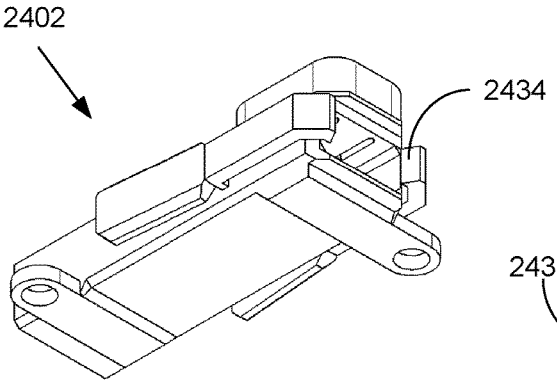
Figure 31I:
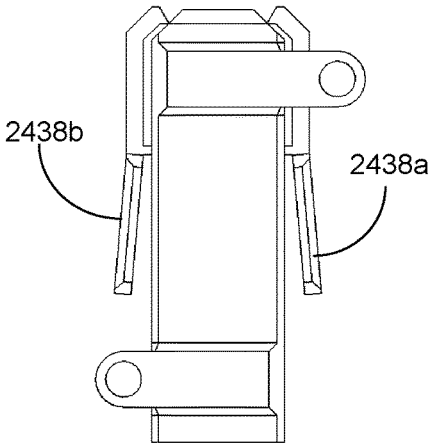
Figure 31J:
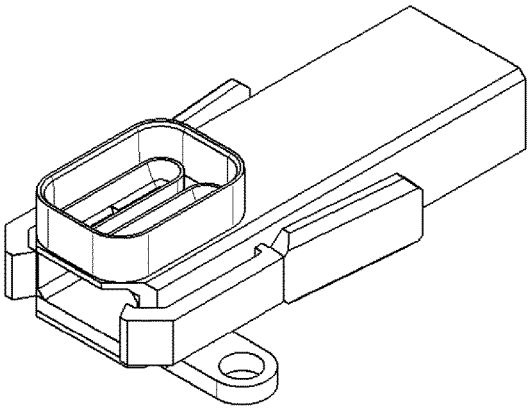

FIGS. 9 and 10 illustrate perspective views of the Dog Actuator Ring. The Dog Actuator Ring 102 defines an opening 906 and may include a Ring Body 902 and an external flange 904, where the Ratchet Release Flange 128 is mounted to the external flange 904. The Ring Body 902 may define a plurality of Spiral Ramps 132. In one example, each Spiral Ramp 132 may be a groove in the Ring Body 902 that extends partially around the ring at an angle from a first end 908 to a second end 910. The internal perimeter of the Dog Actuator Ring 102 includes the Dog Actuator Rotation Assist Flange 126 that permits manual rotation of the Dog Actuator Ring 102. Note that when installation is completed, as illustrated in FIGS. 22 and 23, the external flange 904 is adjacent to the internal flange 504. However, before installation (i.e., prior to rotating the Dog Actuator Ring 102 relative to the Mounting Frame 104), the external flange 904 is separated from the internal flange 504. When the recessed speaker assembly 100 is being inserted into an opening for installation, the Dog Gears 410 are engaged to the Dog Actuator Gears 130, leaving the Rotating Dogs 106 out of the way. Once the recessed speaker assembly 100 is inserted into the opening, the Dog Actuator Ring 102 is rotated relative to the Mounting Frame 104, to attach the assembly 100 in place. As the Dog Actuator Ring 102 is initially turned, the Dog Actuator Gears 130 turn the Dog Gears 410 so that the Spiral Ramp Engagement Pin 402 (FIG. 4) engages the Spiral Ramp 132. At this point, the Dog Foot 408 is now positioned outward. As the Dog Actuator Ring 102 is rotated (e.g., clockwise), the Spiral Ramp Engagement Pin 402 engages and slides along the Spiral Ramp 132 from the first end 908 to the second end 910. As the Dog Actuator Ring 102 rotates (e.g., clockwise), the Spiral Ramp Engagement Pin 402 causes the Dog Actuator Ring 102 to be pushed inward toward Mounting Frame 104 (so the gap between the external flange 904 and the internal flange 504 is reduced). As the Spiral Ramp Engagement Pin 402 moves toward the second end 910, the Mounting Frame 104 is secured to a mounting substrate sandwiched between the perimeter flange 116 and the Dog Foot 408. Note that the Spiral Ramps 132 are just a partial segment of the Dog Actuator Ring 102, therefore the Mounting Frame 104 can be secured in place in less than a full turn of the Dog Actuator Ring 102. As the Dog Actuator Ring 102 is rotated, the Ratchet Engagement Flange 1004 engages the Ratchet Teeth 504 to prevent the Dog Actuator Ring 102 from loosening. In this manner, the recessed speaker assembly 100 (e.g., Mounting Frame 104, Dog Actuator Ring 102, Retaining Ring 108, and Latch Trap Ring 110) can be inserted a cavity and coupled a mounting substrate with a single manual turn of the Dog Actuator Ring 102, without the need to individually tighten each rotating dog or fastener.

To disengage, the Ratchet Release Lever 140 is manually depressed so that the Ratchet Engagement Flange 1004 disengages from the Ratchet Teeth 504. The Dog Actuator Ring 102 is then rotated in the opposite direction (e.g., counterclockwise), which causes the Dog Actuator Gear 130 to slide within the Spiral Ramp 132 from the second end 910 to the first end 908. Upon reaching the first end 908, the reverse rotation (e.g., counterclockwise) of the Dog Actuator Ring 102 causes the Dog Gears 410 to become engaged to the Dog Actuator Gears 130. This rotation of the Rotating Dog Gears 410 causes the Dog Foot 408 to rotate inward so that the recessed speaker assembly 100 can be removed. In this manner, the recessed speaker assembly 100 (e.g., Mounting Frame 104, Dog Actuator Ring 102, Retaining Ring 108, and Latch Trap Ring 110) can be disengaged (by pressing on the Ratchet Release Lever 140) by a single manual reverse turn or rotation of the Dog Actuator Ring 102, without the need to individually disengage each rotating dog or fastener.

Zero Tool, Linear Snap-Lock Baffle Attachment System

According to yet another feature, a near instantaneous mechanical assembly between a loudspeaker Baffle Assembly and a preinstalled Mounting Baffle Assembly can be achieved while simultaneously making the electrical connections required for the previously installed and wired Mounting Baffle Assembly. No pre-alignment is required other than inserting the Baffle Assembly into the Mounting Frame opening. Any rotational orientation is allowed, and the system makes and maintains an electrical connection regardless of the insertion orientation. The latching system is spring tensioned such that pushing inward slightly unloads the retention latches sufficiently to allow after insertion rotation in those applications that incorporate angled transducers. The spring tensioning system also accommodates tolerance variations ensuring tight mechanical connections. The latching method described is small enough to fit into the space normally allowed between the low frequency transducer and the outer diameter of the Baffle molding, thereby requiring very little, if any, increase in the system's overall diameter.

Figure 11:
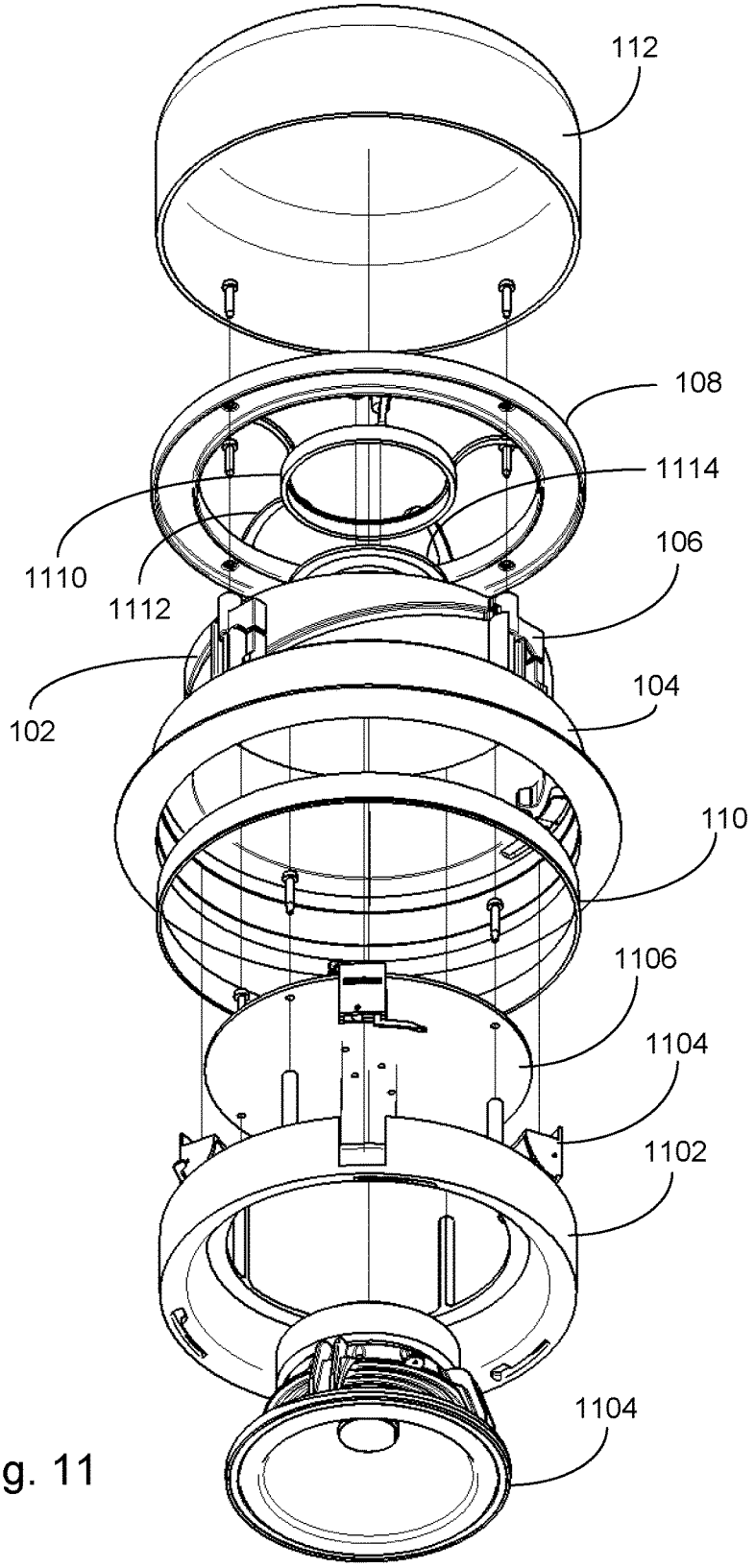
FIG. 11 illustrates how additional components may be coupled to the recessed speaker assembly.
Figure 12:
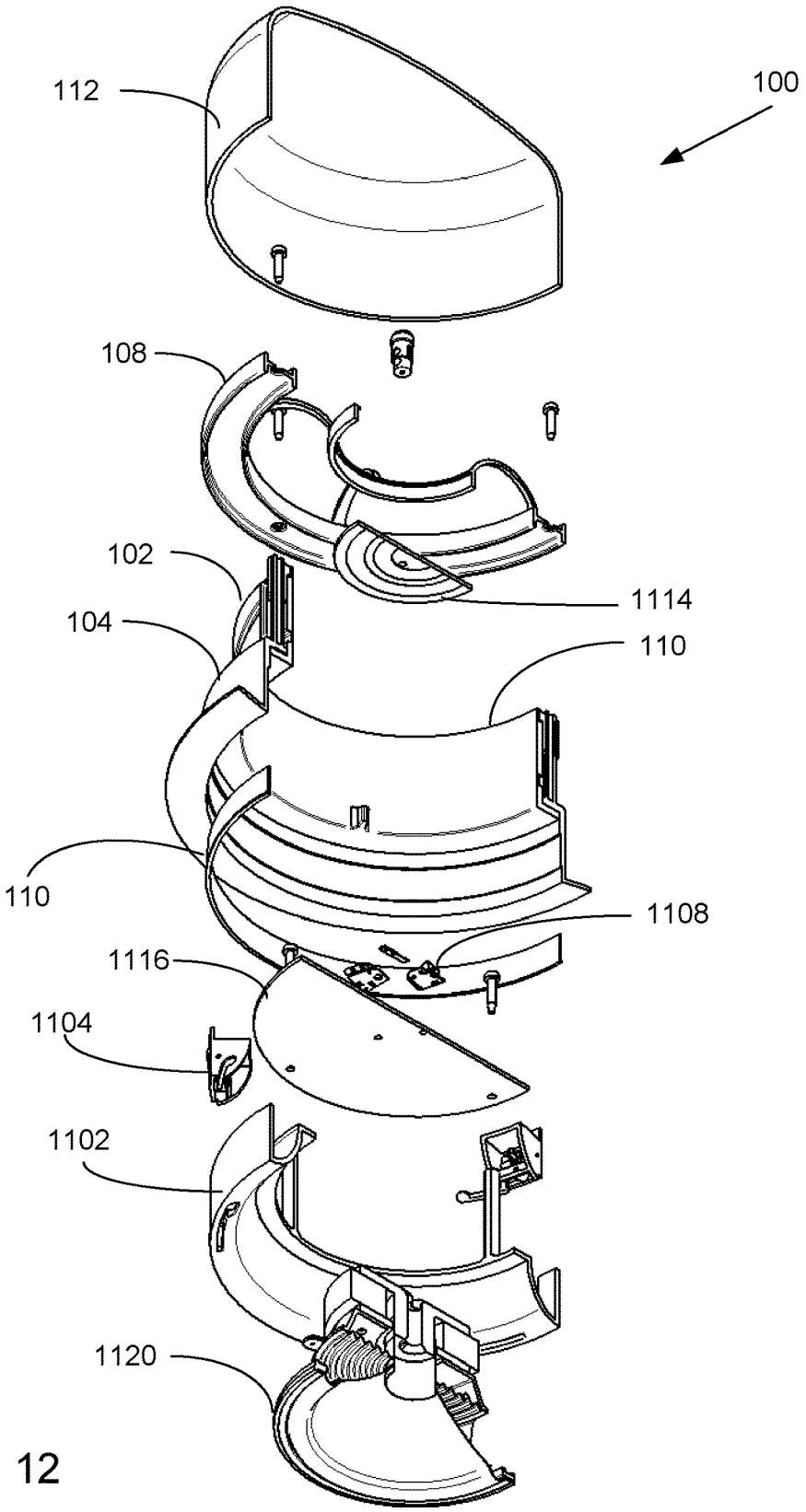
FIG. 12 illustrates a cross-sectional view of the recessed speaker assembly of FIG. 11.

FIG. 11 illustrates how additional components may be coupled to the recessed speaker assembly 100. FIG. 12 illustrates a cross-sectional view of the recessed speaker assembly of FIG. 11.

In one example, recessed speaker assembly 100 may further include a Baffle 1102, a plurality of Latch Assemblies 1104, a Network Printed Circuit Board (PCB) 1106, a plurality of Rotating Contact Assemblies 1108, and a Connector Support Ring 1110. The Connector Support Ring 1110 is coupled by a plurality of ribs 1112 and supported by the Retaining Ring 108. The Connector Support Ring 1110 serves as a support for a Contact PCB 1114 which may provide audio signals or power to the recessed speaker assembly 100. An audio transducer 1120 may be mounted our coupled within the Baffle 1102. The plurality of Latch Assemblies 1104 are coupled to the perimeter of the Baffle 1102 (on the inner side of the Baffle 1102) and serve to couple and engage the Baffle 1102 to the Mounting Frame 104.

Figure 13:
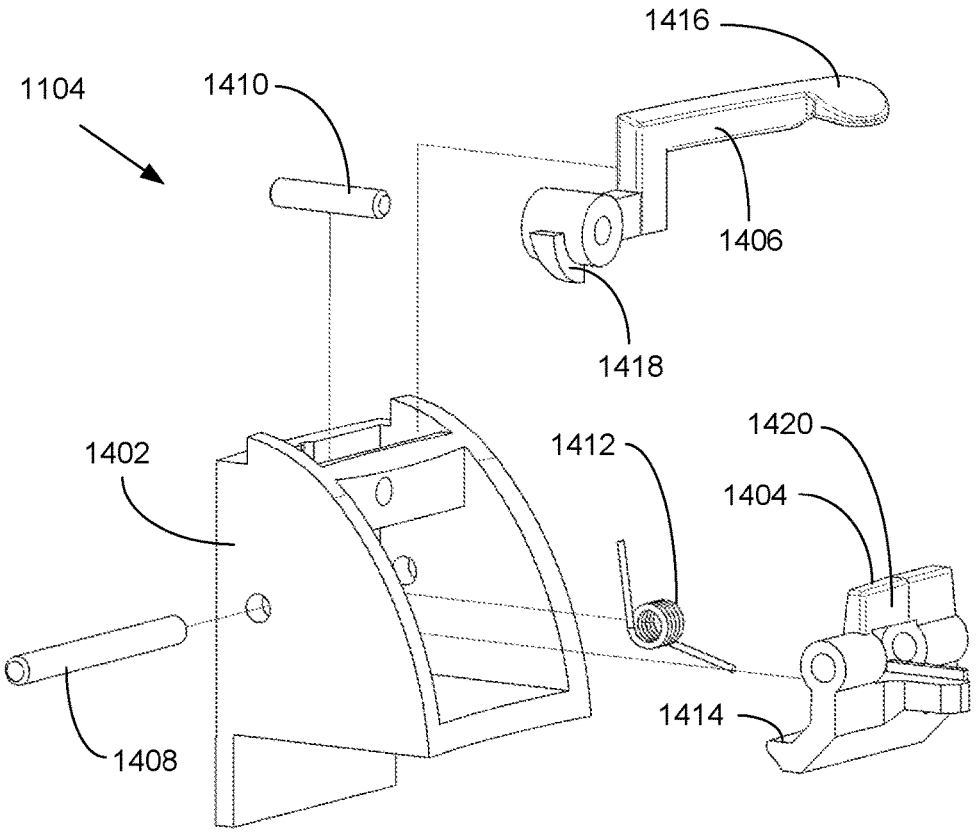
FIGS. 13, 14 and 15 (comprising FIGS. 15*a-o*) illustrate various views of an example of a Latch Assembly.
Figure 14:
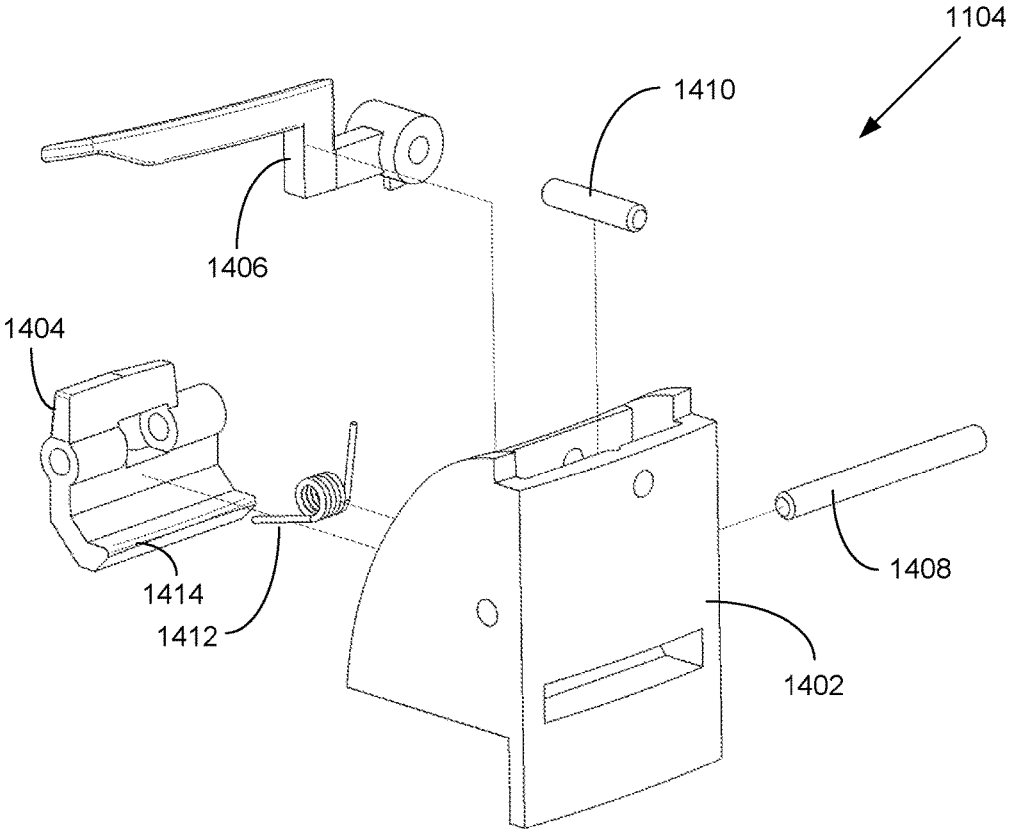
Figure 15J:
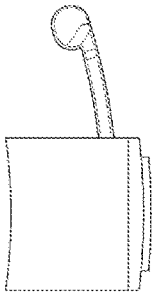
Figure 15K:
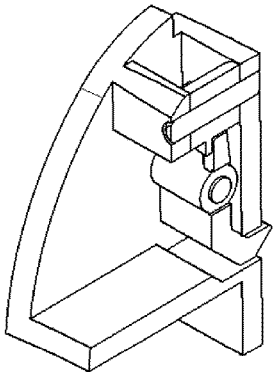
Figure 15L:
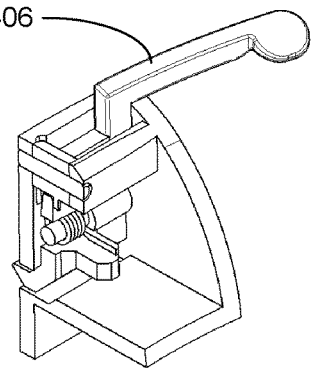
Figure 15M:
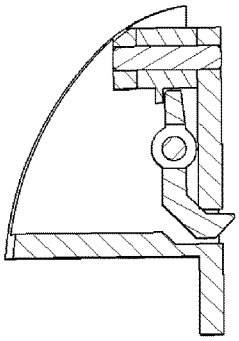
Figure 15O:
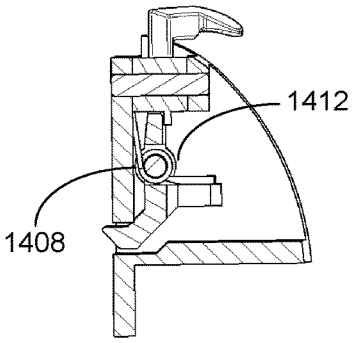
Figure 15N:
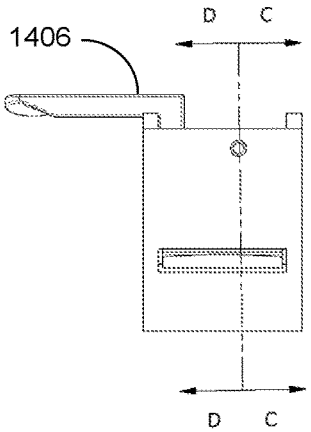

FIGS. 13, 14 and 15 (comprising FIGS. 15*a-o*) illustrate various views of an example of the Latch Assembly 1104. The Latch Assembly 1104 may include a Latch Carrier 1402, a Latch 1404, a Rotating Wedge 1406, a Latch Pin 1408, a Rotating Wedge Pin 1410 and a torsion Latch Spring 1412. The Latch Assembly's 1104 Latch 1404 is activated and held in position by the torsion Latch Spring 1412. During the Baffle Assembly's insertion, the Latch's 1404 Latch Foot 1414 is held in an "out" position by the Latch Spring 1412, thereby enabling the Latch Foot 1414 to engage the Latch Trap Ring 110, which causes the Baffle to be secured to the Mounting Frame 104. Consequently, the installation of the Baffle 1102 simply requires inserting the Baffle 1102 into the previously mounted or installed recessed speaker assembly 100 (e.g., Mounting Frame 104, Dog Actuator Ring 102, Retaining Ring 108, and Latch Trap Ring 110).

When it is desired to remove the Baffle 1102 from the Mounting Frame 104, the Latch's 1404 Latch Foot 1414 is disengaged by lifting the Lever 1416 to turn the Spiraling Wedge 1418 ninety (90) degrees upward. In one example, the Spiraling Wedge 1418 may be molded into the Rotating Wedge 1406. As it is rotated around the Rotating Wedge Pin 1410, the Spiraling Wedge 1418 engages the Rotating Wedge Engagement Flange 1420 located on the Latch 1404. As the Lever 1416 is lifted, the Spiraling Wedge 1418 forces the Latch 1404 to rotate against the tension of the Latch Spring 1412 causing the Latch Foot 1414 to disengage from the Latch Trap Ring 110, thereby allowing the Baffle Assembly 1102 to be removed from the Mounting Frame 104. Note that by lifting the Lever 1416 in a first direction, this causes the Latch to pivot in a second direction.

In many prior art recessed speakers, wires must be attached when inserting the Baffle 1102 and audio transducer 1120 into the Mounting Frame 104. However, the present recessed speaker assembly 100 avoids the step of making separate electrical connections. Instead, Rotating Contact Assemblies 1108 are used and serve both the purpose of tensioning the Latch Assembly's 1104 Latch Foot 1414 against the Latch Trap Ring 110 and to simultaneously provide a means for making an electrical connection to the Mounting Frame 104.

Figure 16:
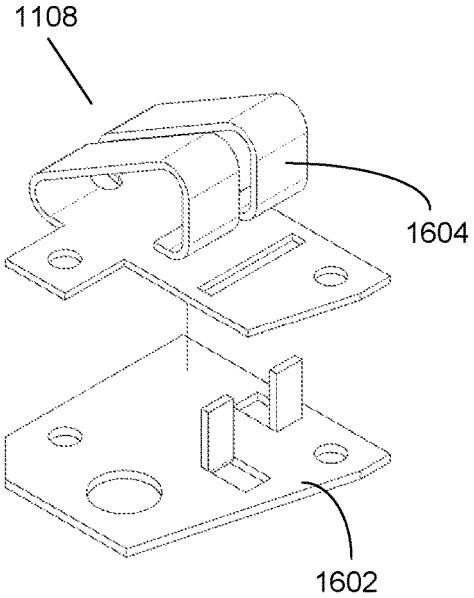
FIG. 16 illustrates an example of a Rotating Contact Assembly.

FIG. 16 illustrates an example of the Rotating Contact Assembly 1108. The Rotating Contact Assembly 1108 may be made up of two components a Contact Base 1602 and a Flexible Contact 1604. The Rotating Contact Assembly 1108 is made up of two different components: a Contact Base 1602 and a Flexible Contact 1604. The Contact Base 1602 may be made of a structurally stiff, thick material that is not prone to flexing. The Flexible Contact 1604 may be constructed of a spring steel material so as to allow for substantial flexure without fatiguing over time. The two are riveted together. The Flexible Contact 1604 allows for up to 0.100" of movement, while maintaining constant pressure, which gives the system its ability to accommodate mechanical tolerance variations.

The plurality of Contact Assemblies 1108 engage a plurality of Contact Rings 1702 etched into the Contact PCB 1114 mounted on the Retaining Ring's 108 Connector PCB Support Ring 1110 which in turn is a part of the Mounting Frame 104. The Contact PCB 1114 is positioned within the Retaining Ring's 108 Connector PCB Support Ring 1110 at a distance from the installed Baffle Assembly to allow for appropriate contact to be made with the plurality of Contact Assemblies 1108 located on the Network PCB 1116.

Figure 17B:
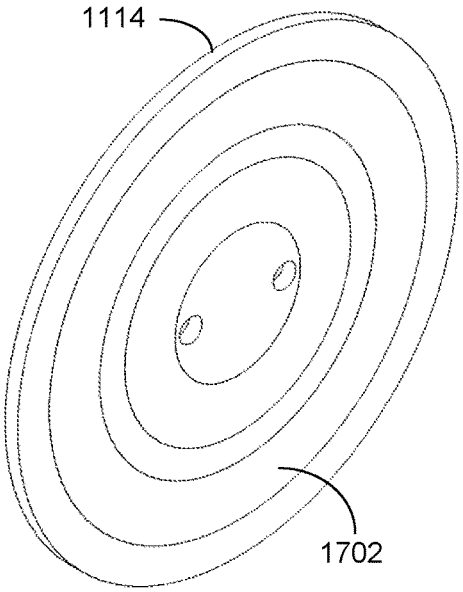
FIG. 17 illustrates an example of a Contact PCB.
Figure 17A:
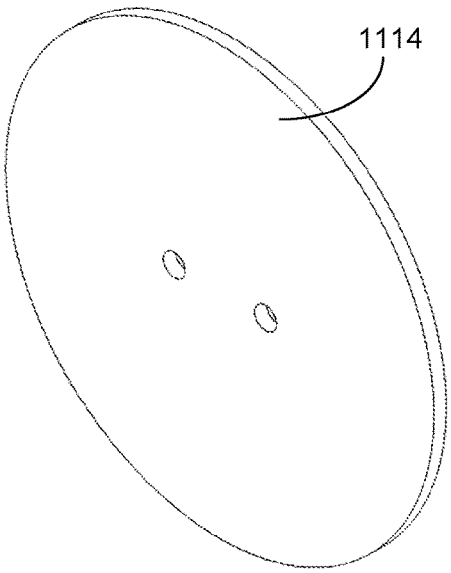

FIG. 17 illustrates an example of the Contact PCB 1114. Note that the Contact PCB 1114 may be shaped as at least one circular contact ring 1702. The Rotating Contact Assembly 1108 comes into contact with the contact ring 1702 to complete an electrical circuit even as the Baffle 1102 is rotated while engaged to the mounting frame 104.

Figure 18:
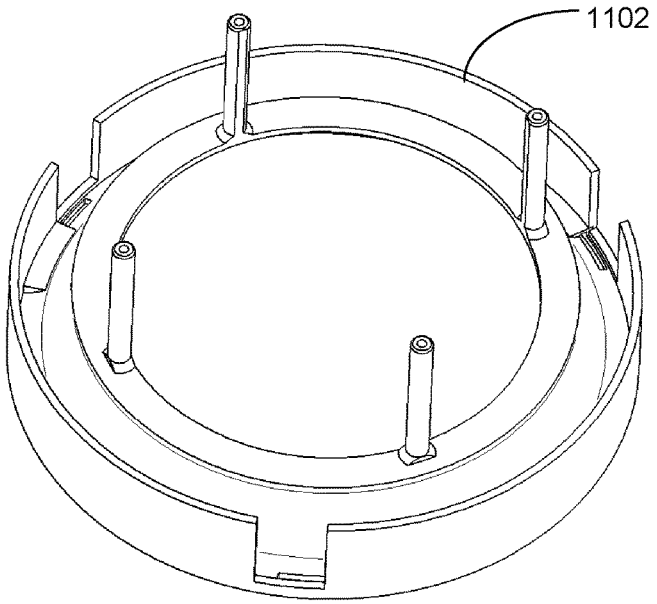
FIGS. 18 and 19 illustrate opposite sides of a Baffle.
Figure 19:
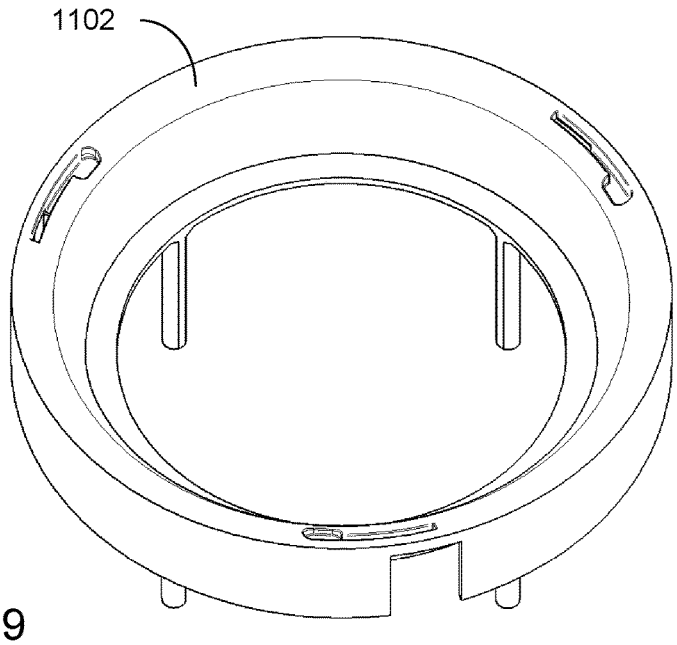

FIGS. 18 and 19 illustrate opposite sides of a Baffle.

Figure 20:
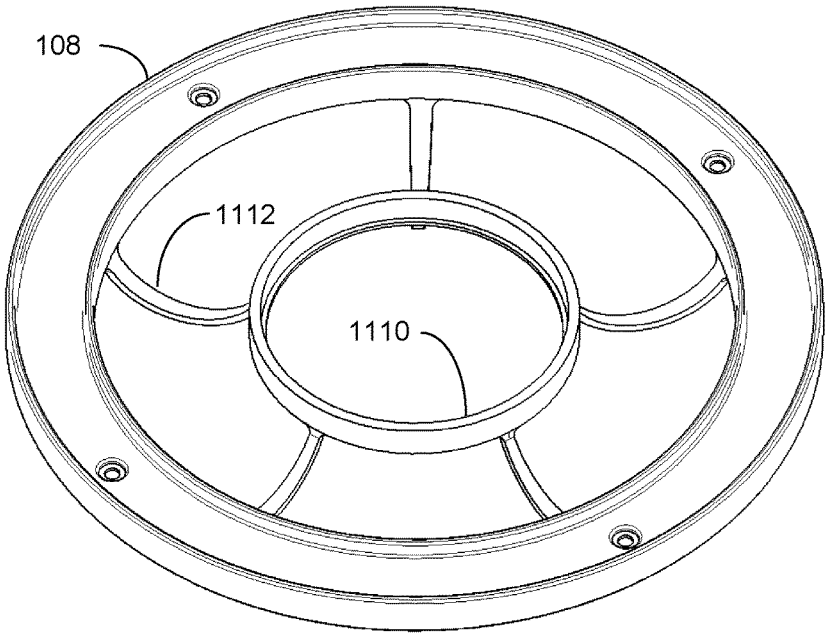
FIGS. 20 and 21 illustrate opposite sides of a Retaining Ring.
Figure 21:
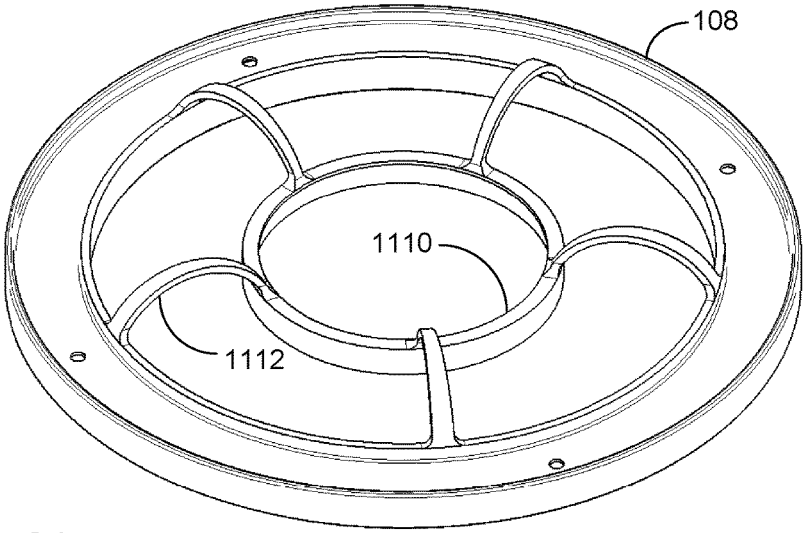

FIGS. 20 and 21 illustrate opposite sides of a Retaining Ring.

FIGS. 22 and 23 illustrate an example of a speaker assembly.

Zero Strip Wire Connection System

Yet another feature provides a wire terminating (connector) device that does not require the wire ends to be stripped of insulation to be terminated. The wire terminating device may be small in dimension, enabling its use in tight quarters. Optionally, the wire terminating device seals the connection from environmentally induced electrical degradation by injecting a silicone grease into areas so exposed, which makes the device particularly advantageous in marine applications. In addition, the connector is able to terminate wires of various gauges, ranging generally from 12 to 18 gauge, including wiring that includes a thick insulation, specifically as may be used in high gauge, stranded loudspeaker wire. This is an unusual advantage as other no-strip devices have a difficult time penetrating varying thicknesses and hardness of insulation.

FIGS. 24, 25, 26, and 27 illustrate various perspective, exploded, and/or cross-sectional views of one example of a wire terminating or connection device 2400. The wire connection device 2400 may comprise a Connector Base 2402 coupled to a Wire Guide 2404 at a first end and coupled to a Back Cover 2406 at an opposite second end. The Wire Guide 2404 may include a Wire Retainer 2407 to retain an inserted wire through each opening 2408. The Wire Guide 2404 and Wire Retainer 2407 serve to support and position the inserted wire and are permanently and irretrievably attached to the inserted wire. If it becomes necessary to replace the wire, the Wire Guide 2404 and Wire Retainer 2407 can be decoupled from the Connector Base 2402 and a new Wire Guide 2404 and Wire Retainer 2407 can be inserted.

To make an electrical connection between the inserted wire and the Terminal 2410, a penetrating electrical connection is used comprising a Needle Wire Penetrator 2412, a Needle Shroud 2414, and a Needle Shroud Spring 2416. Once a wire is inserted and electrically coupled to the Terminal 2410, a Grease Pill Piston 2418 can be depressed to push on a Grease Pill 2420 which flows into the Needle Shroud 2414 and serves to insulate the connection to the inserted wire. As can be appreciated in FIG. 25, each wire connection device 2400 may provide connectors for two or more (i.e., a plurality of wires).

The sequence of installation is as follows. The installer clips an end of the wire to be inserted (but does not strip the insulator) with a pair of wire cutters to ensure a clean exposure of wire end. The installer takes the Wire Guide 2404 preassembled with a Wire Retainer 2407, and forces the Wire Guide 2404 onto the ends of the wire to be inserted as far as the wire will penetrate into the Wire Guide 2404. The installer then presses down on the Wire Retainer 2407 to lock the wire into place. The Wire Retainer 2407 incorporates a Wire Retainer Ratchet 2422 that engages a pair of non-reversible Wire Retainer Latches 2424 located on the sides of the Wire Guide 2404. The Wire Guide 2404 is able to accommodate varying gauges by employing a tapered, cone shaped hole, referred to here as a Wire Guide Taper 2430. Regardless of the inserted wire diameter, the Wire Guide Taper 2430 always centers the wire. Of course the smaller gauges will move further up the tapered hole 2408 and the larger gauges will not penetrate into the Wire Guide Taper 2430 as far. The advantage of the Wire Guide Taper 2430 is its ability to center/position wires with a large range of diameters.

After the Wire Guide 2404 is securely coupled to the end of the inserted wire, the installer makes a connection by inserting the Wire Guide 2404 into a Wire Guide Receptacle 2432 of the Connector Base 2402. As the Wire Guide 2404 is inserted into the Wire Guide Receptacle 2432, the Wire Guide 2404 encounters and displaces the Needle Shroud 2414, which in turn exposes the tips of the Needle Wire Penetrators 2412 via the Needle Wire Penetrator Guide 2450. Note that as the Needle Shroud 2414 is being pushed back by the Wire Guide 2404, the Needle Shroud Springs 2416 push on the Needle Shroud 2414. The Needle Wire Penetrators 2412 are electrically coupled to corresponding Terminals 2410 and are fixed in place relative to the Connector Base 2402. As the Wire Guide 2404 is inserted into the Wire Guide Receptacle 2432, and because the inserted wire is centered and held fast in the Wire Guide 2404, the Needle Wire Penetrator 2412 is forced into the very end of the inserted wire at some varying position down the Wire Guide Taper 2430 depending on the diameter of the wire and its insulation. Simultaneous with these actions, the Wire Guide Latches 2434 encounters and engages a Wire Guide Latch Ratchet 2436 of the Wire Guide 2404, thereby securing the Wire Guide 2404 in the Connector Base 2402. These features secure the Wire Guide 2404 into the Connector Base 2402 regardless of how far the Wire Guide 2404 enters into the Wire Guide Receptacle 2432. To remove the Wire Guide 2404, the installer may press on the Latch Release Levers 2438 to release the Wire Guide Latch's 2434 hold on the Wire Guide Latch Ratchet 2436. The Wire Guide 2404 can then be pulled free from the Connector Base 2402.

In this manner, the wire connection device 2400 forces a large diameter needle 2412 (e.g., having a nominal shank diameter of about 0.030") into the exposed end of the inserted wire. This "needle down the end" approach has great advantages over the prior art methods that choose to penetrate the wire insulation from the side. Depending on the wire insulation thickness and hardness, the "side penetrator" approach may or may not come into contact with the inserted wire, let alone yield a reliable contact with the wire. At best, the side penetrator's ability to conduct current is limited due to the limited contact between the penetrator and the wire strands. By contrast, the disclosed "needle down the end" approach offers much higher contact with the wire and, therefore, much better potential for transmitting higher currents.

How far the Wire Guide 2404 enters into the Wire Guide Receptacle 2432 depends on the diameter of wire in use. The smaller the wire diameter the further the Wire Guide 2404 will move into the Connector Base 2402, hence the need for the long Needle Wire Penetrators 2412. When the Needle Wire Penetrator 2412 penetrates the inserted wire end, the wire's insulation may expand slightly to accommodate the added diameter of the Needle Wire Penetrator 2412. With the inserted wire held firmly in the Wire Guide Taper 2430 there would be nowhere for the material to expand. Hence, the Taper Ridges 2440 are arrayed around the diameter of the Wire Guide Taper 2430. These features facilitate the proper positioning of the inserted wire end and allow for a small expansion of the inserted wire's diameter as the Needle Wire Penetrator 2412 moves into the inserted wire end.

Additionally, the wire connector device 2400 is able to inject insulating silicone grease into the cavities after the electrical connection has been made. The grease injection system includes a Grease Pill Piston Guide 2442 molded onto the top of the Connector Base 2402, the Grease Pill Piston 2418, and a pair of Grease Pills 2420. The Grease Pill 2420 may be like a large flexible vitamin pill, with walls that can be ruptured as desired with relative ease. The connector 2402 may be shipped with the Grease Pills 2420 resting loosely on the Pill Tray 2446 and the Grease Pill Piston 2418 placed loosely into the Grease Pill Piston Guide 2442. After the electrical connection has been made, the installer presses firmly down on the Grease Pill Piston 2418. This causes the Grease Pill 2420 to come in contact with the Pill Penetrator 2444 rupturing the Grease Pill 2420. The released grease is forced down through the Wire Guide's 2404 Grease Injection Slots 2448, flooding the cavities with silicone grease, thereby greatly increasing the electrical connection's isolation from environmental effects.

FIG. 28 (comprising FIGS. 28*a-i*) illustrates various views of one example of the Wire Guide 2404.

FIG. 29 (comprising FIGS. 29*a-g*) illustrates various views of one example of the Wire Retainer 2407.

FIG. 30 (comprising FIGS. 30*a-g*) illustrates various views of one example of the Back Cover 2406.

FIG. 31 (comprising FIGS. 31*a-j*) illustrates various views of one example of the Connector Base 2402.

Figure 32:
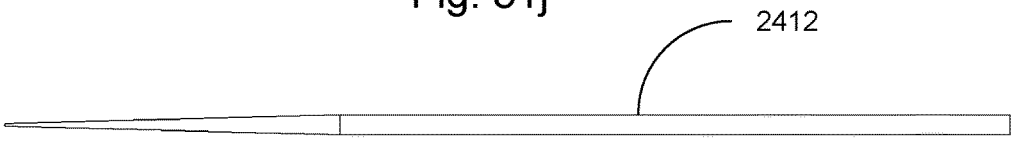
FIG. 32 illustrates various views of one example of a Needle Wire Penetrator.
Figure 33A:
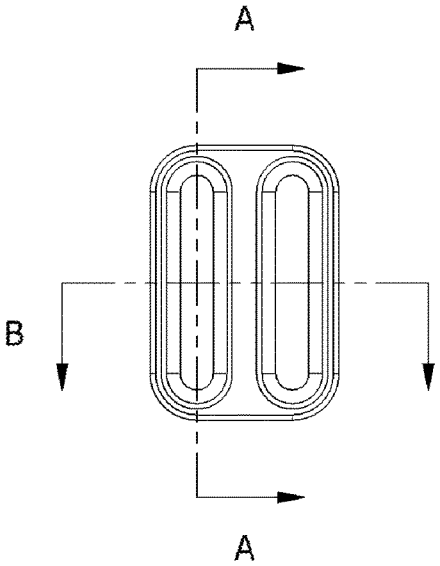
FIG. 33 (comprising FIGS. 33*a-g*) illustrates various views of one example of a Grease Pill Piston.
Figure 33B:
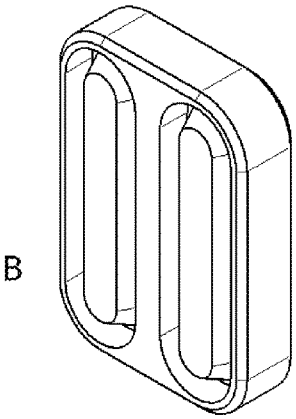
Figure 33C:
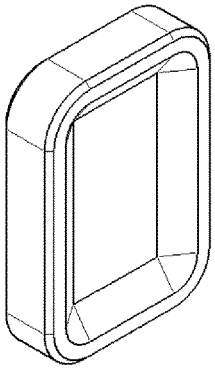
Figure 33D:
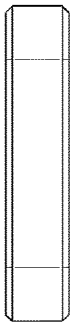
Figure 33E:
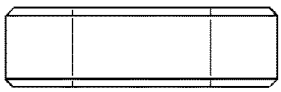
Figure 33F:
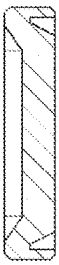
Figure 33G:
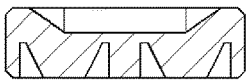

FIG. 32 illustrates various views of one example of the Needle Wire Penetrator 2412.

FIG. 33 (comprising FIGS. 33*a-g*) illustrates various views of one example of the Grease Pill Piston 2418.

Wall Mounted Loudspeaker Quick Install Bracket System

Another novel aspect provides a wall/ceiling loudspeaker mounting that uses a light-weight, easy to hold and position bracket system that subsequently allows near instantaneous mechanical and electrical installation of its related loudspeaker system. Using a small and light "base bracket" as the first mechanical interface to the wall or ceiling structure makes aligning and securing much more installer friendly.

An electrical interface is included on the Wall Mounting Bracket that allows the installer to make all required electrical connections as part of the initial mechanical installation. This further simplifies the installation as all work is done in the open and not behind something or while holding a heavy, awkward loudspeaker system.

Figure 34:
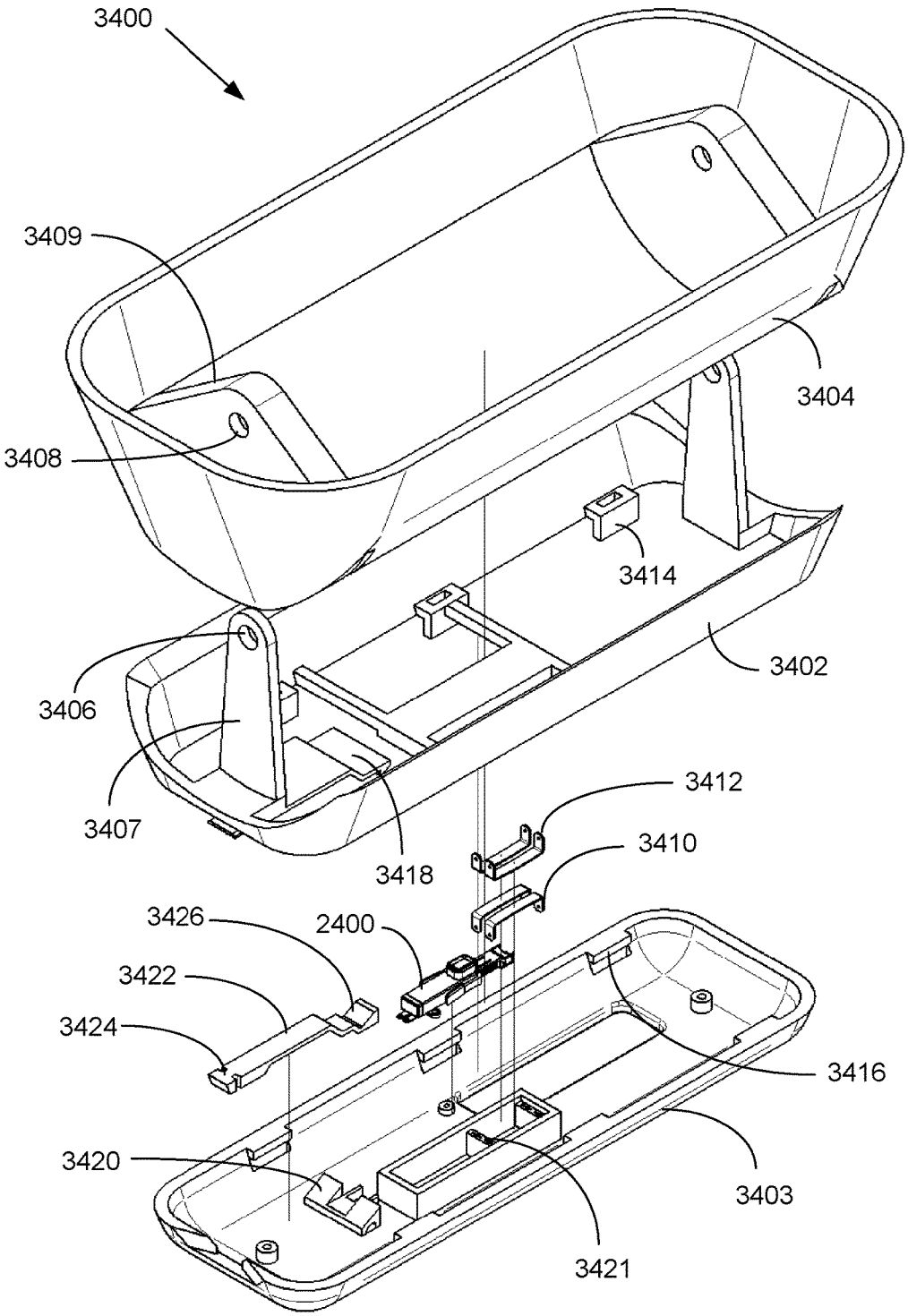
FIGS. 34, 35, and 36 illustrate various exploded views of a wall or ceiling mounted pivoting speaker assembly.
Figure 35:
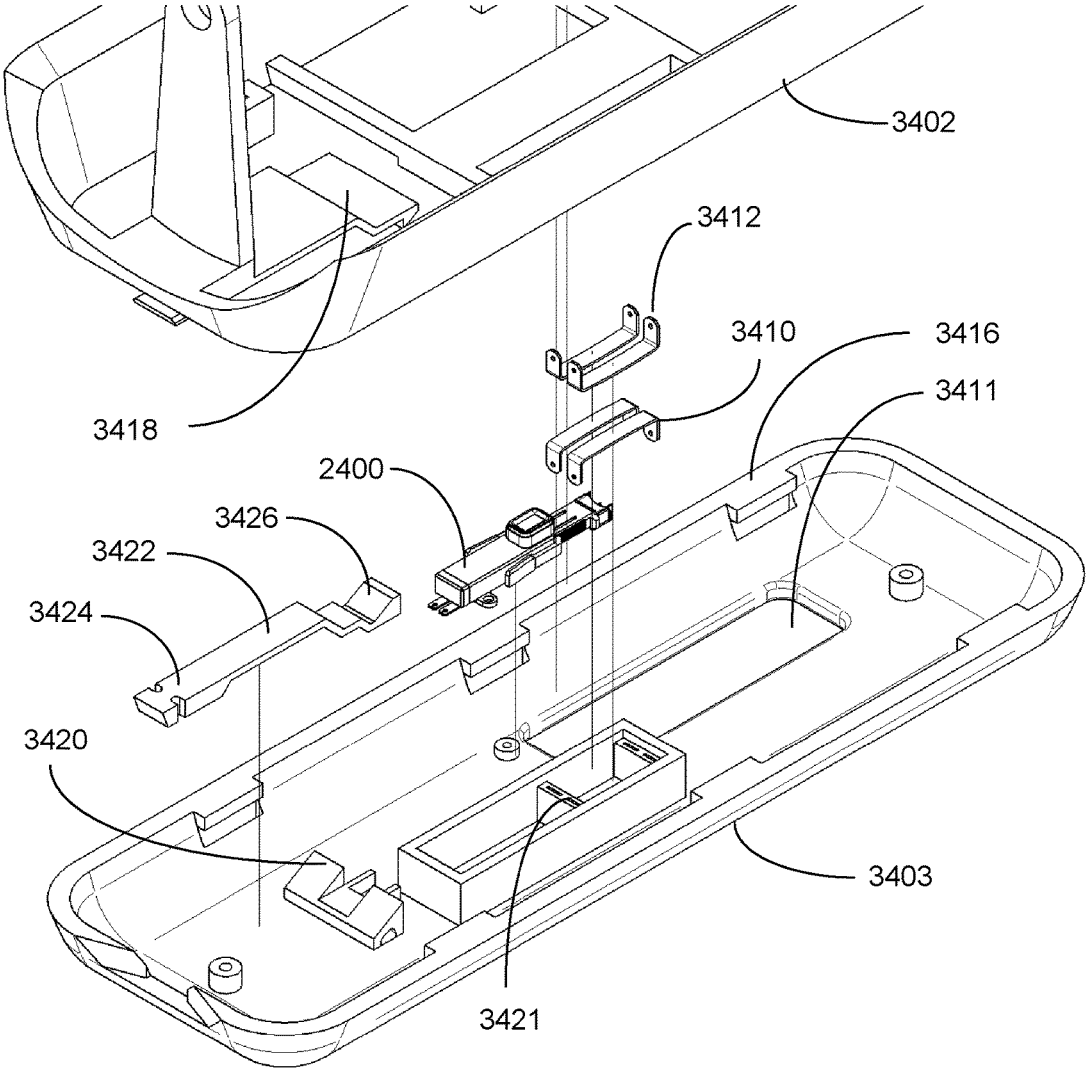
Figure 36:
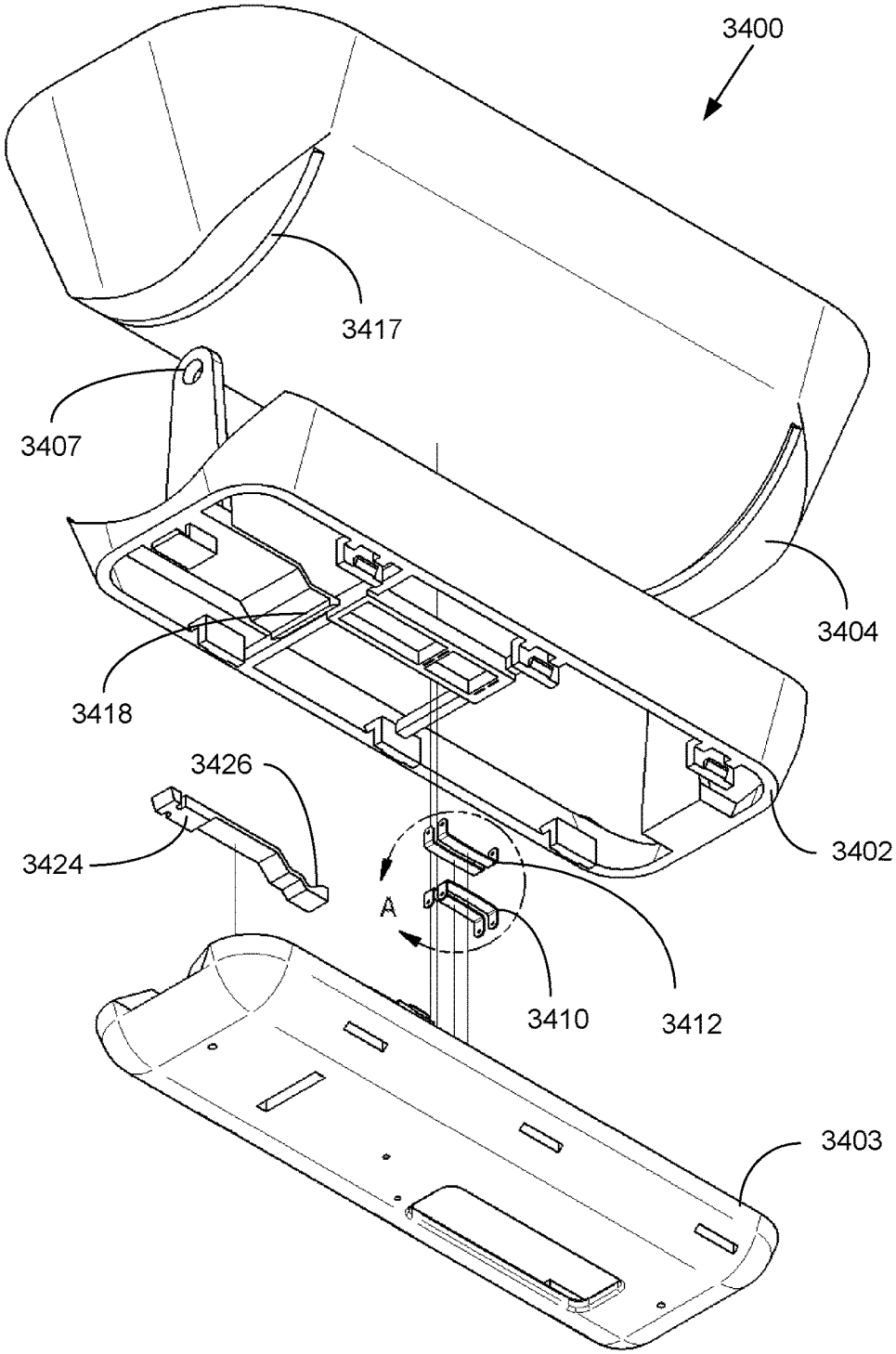
Figure 37A:
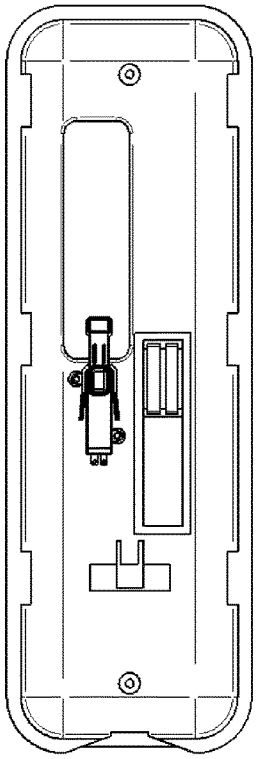
FIG. 37 (comprising FIGS. 37*a-h*) illustrates various views of a Mounting Bracket according to one example.
Figure 37B:
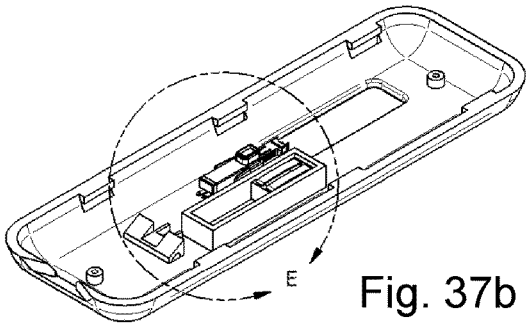
Figure 37C:
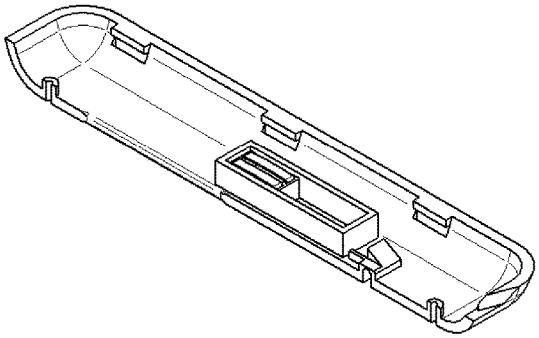
Figure 37D:
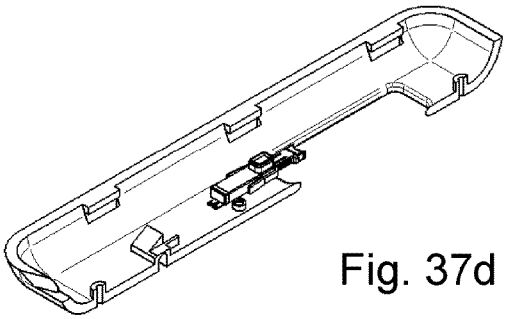
Figure 37E:
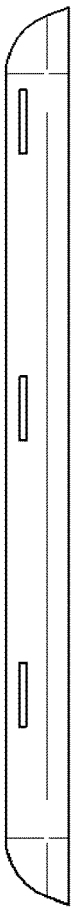
Figure 37F:
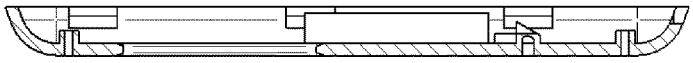
Figure 37G:
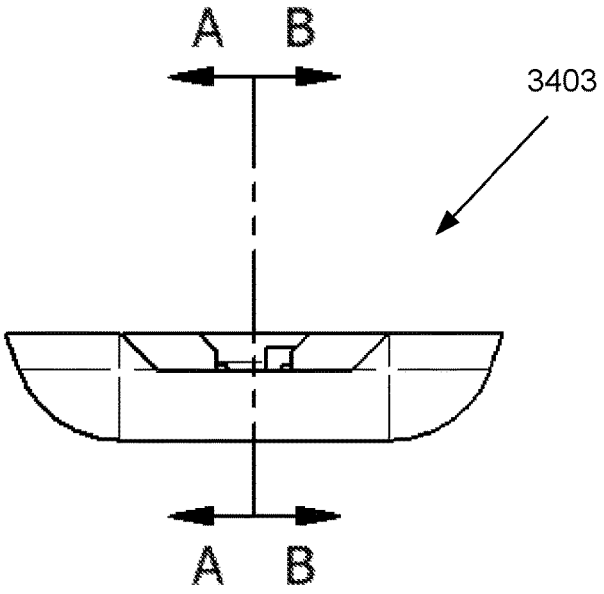
Figure 37H:
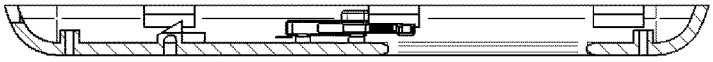

FIGS. 34, 35, and 36 illustrate various exploded views of a wall or ceiling mounted pivoting speaker assembly 3400.

The pivoting speaker assembly 3400 may comprise a Wall Mounting Bracket 3403, a Hinge Bracket 3402, and a speaker cabinet 3404. The Hinge Bracket 3402 slides onto and is latched into the pre-mounted Mounting Bracket 3403. The Hinge Bracket 3402 facilitates the "angling" of the loudspeaker after installation via a pivoting hinge formed by a Hinge Bracket Hinging Axis 3406 and a Cabinet Hinging Axis 3408. That is, the Hinge Bracket 3402 may include pivot supports 3407 that pass through a slit 3417 in the speaker cabinet 3404 and are pivotably coupled to a corresponding support 3409. This allows the speaker cabinet 3404 to be directed or pivoted in different directions.

Note that once the Mounting Bracket 3403 has been affixed to a supporting substrate or surface, the pivoting speaker assembly 3400 is a designed so that no additional electrical connections are needed to carry a sound signal to an audio speaker or transducer mounted in the speaker cabinet 3404. When the Mounting Bracket 3403 is attached to the supporting surface, the installer may also attach audio and/or electrical wires (via an access opening 3411) to the wire connector device 2400. The wire connector device 2400 may be electrically coupled to electrical contacts (Mounting Bracket Contacts 3410). The Mounting Bracket Contacts 3410 are mounted within a contact housing 3421. When the Hinge Bracket 3402 is attached to the Mounting Bracket 3403, Hinge Bracket Contacts 3412 come into contact with the Hinge Bracket Contacts 3410, thereby providing audio signals and/or power from the Mounting Bracket 3403 to the Hinge Bracket 3402 without the need for physical wires between the two. Note that the From the Hinge Bracket Contacts 3412 may be coupled to the speaker or audio transducer in the cabinet 3404. Consequently, the Hinge Bracket 3402 and/or speaker cabinet 3404 can be detached from the Mounting Bracket 3403 without the need to disconnect wires.

The Hinge Bracket 3402 carries a pair of electrical contacts (Mounting Bracket Contacts) 3410 that match with a corresponding pair of electrical contacts on the Wall Mounting Frame 3403. These contacts 3410 and 3412 may be gold plated (for corrosion resistance) and may be curved and fabricated from a material that enables them to function in a spring mode, such that, as they slide across one another, they are compressed together facilitating both a cleaning action and making and maintaining good electrical contact. The electrical path is thus connected through these mating contacts 3410 and 3412 after the Hinge Bracket 3402 is slid onto the Wall Mounting Bracket 3403.

The Hinge Bracket 3402 is mounted to and retained by the Wall Mounting Bracket 3403 by sliding the Hinge Bracket's Slider Latches 3414 onto/under the Wall Mounting Bracket's Slider Latches Receptacles 3416.

To facilitate theft resistance, the bracket system incorporates a large Primary Latch 3418 that snaps into place over the Primary Latch Receptacle 3420 just as the loudspeaker assembly is slid fully into place. In order to remove the loudspeaker assembly from the Wall Mounting Bracket 3403, a "De-Latching" Bar 3422 is pried by the installer via Prying Slots 3424 molded into the De-Latcher 3422, along its longitudinal axis. The Prying Slots 3424 are accessed via a slot screwdriver and are pried sufficiently to lift the Primary Latch 3418 via a Lifting Ramp 3426 molded into the De-Latcher 3422.

FIG. 37 (comprising FIGS. 37*a-h*) illustrates various views of a Mounting Bracket 3403 according to one example.

Figure 38:
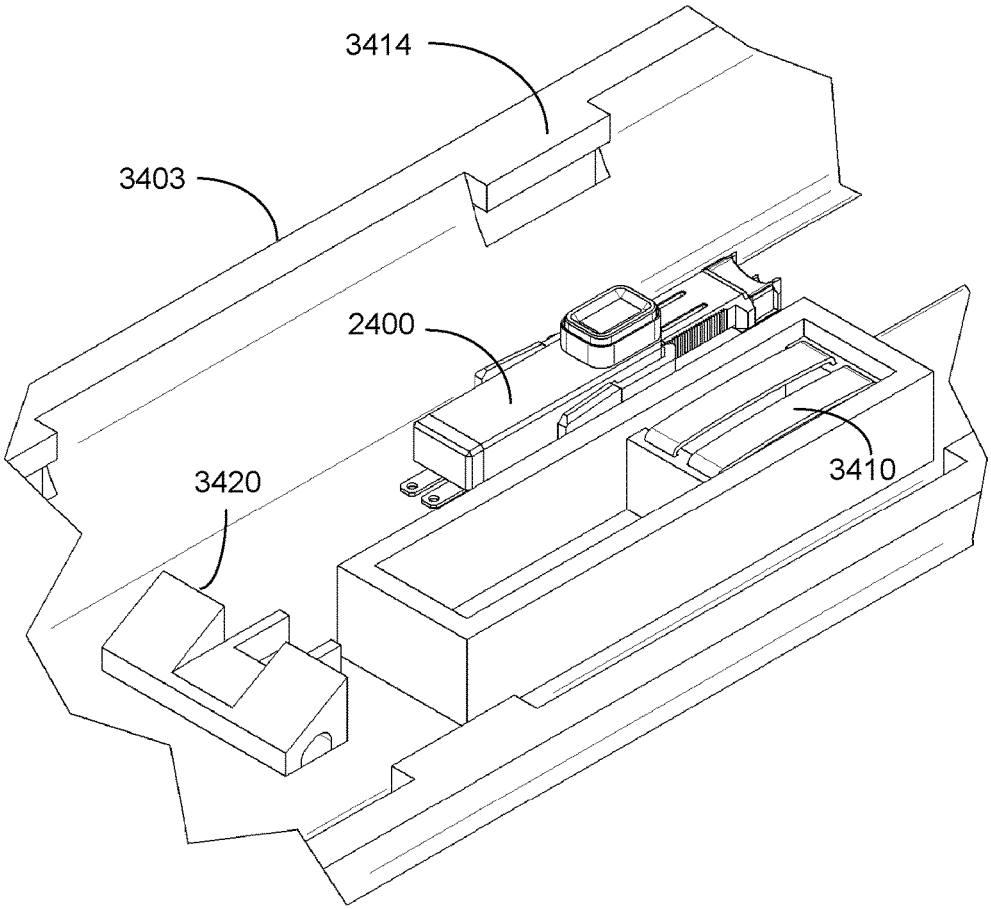
FIG. 38 illustrates a close-up view of the electrical contacts housed in the Mounting Bracket.
Figure 39A:
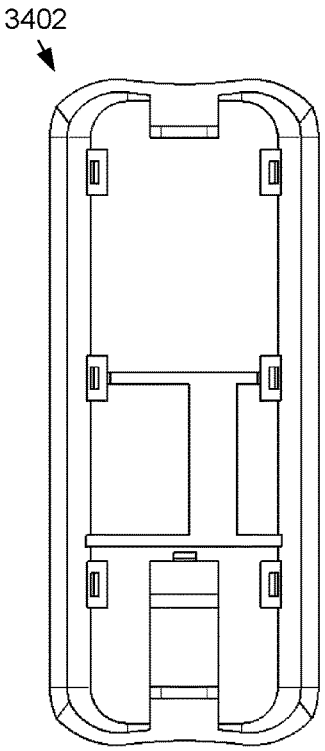
FIG. 39 (comprising FIGS. 39*a-l*) illustrates various views of a Hinge Bracket according to one example.
Figure 39B:
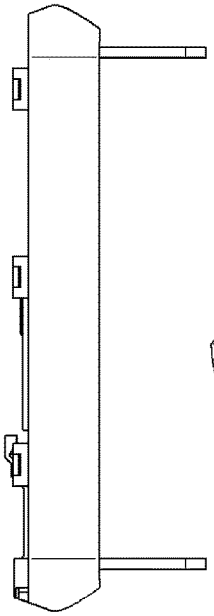
Figure 39C:
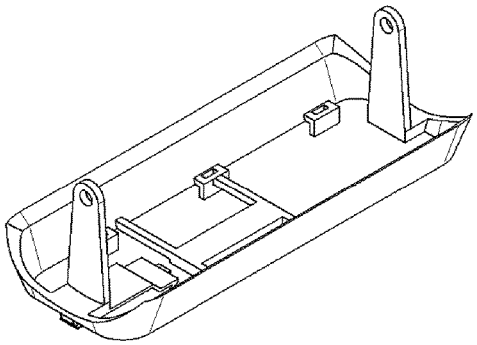
Figure 39D:
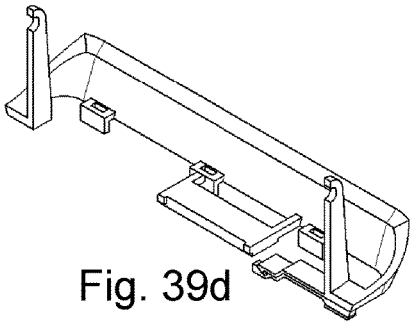
Figure 39E:
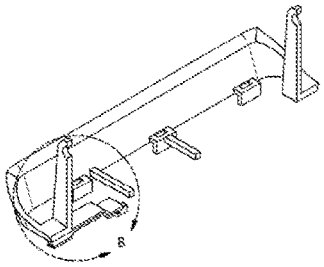
Figure 39F:
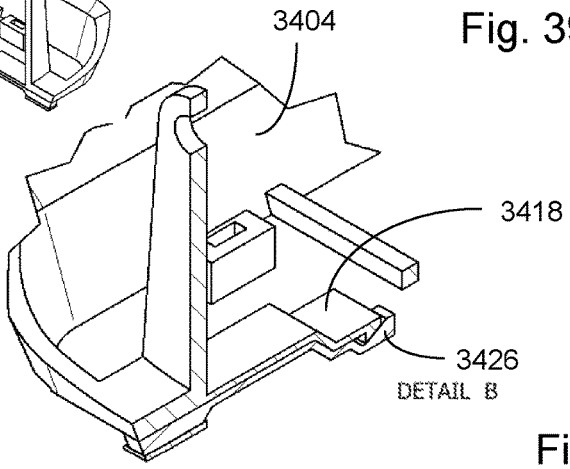
Figure 39G:
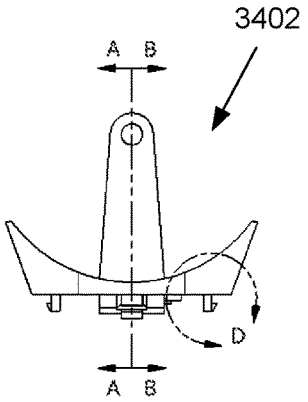
Figure 39H:
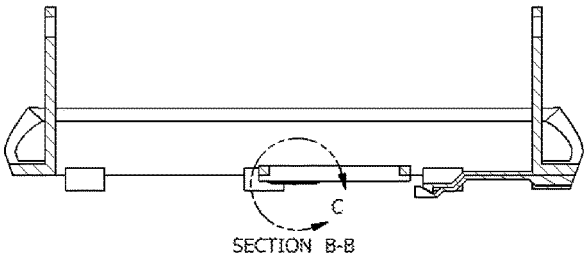
Figure 39I:
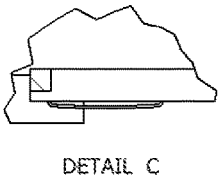
Figure 39J:
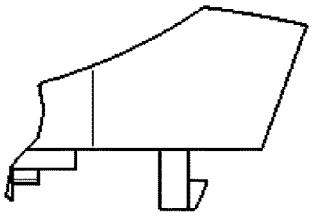
Figure 39K:
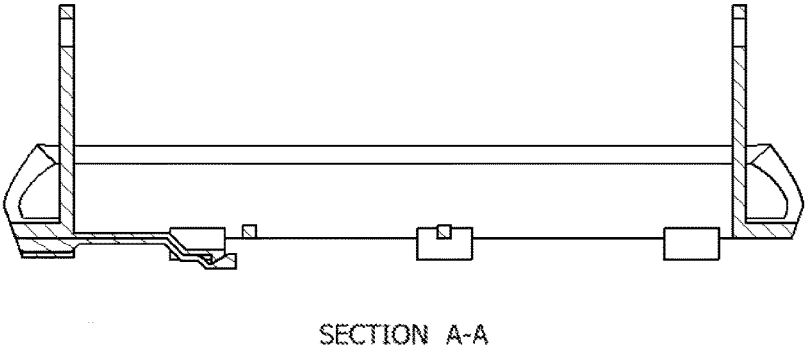
Figure 39L:
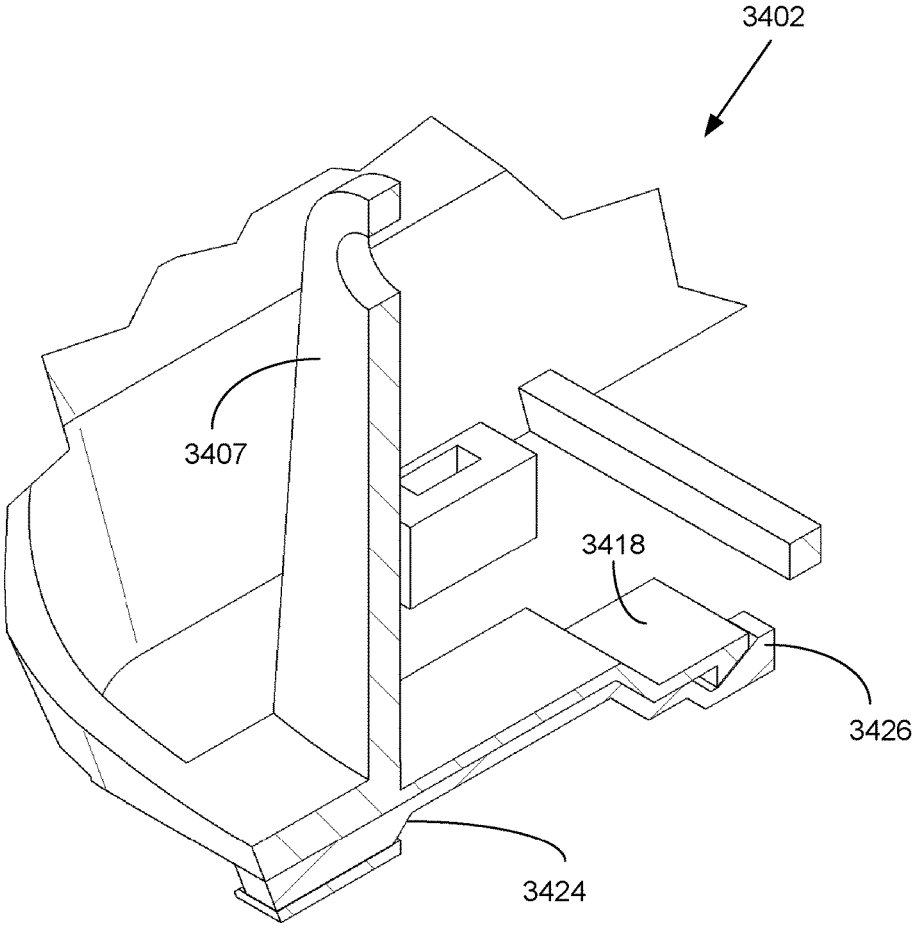

FIG. 38 illustrates a close-up view of the electrical contacts housed in the Mounting Bracket 3403.

FIG. 39 (comprising FIGS. 39*a-l*) illustrates various views of a Hinge Bracket 3402 according to one example.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A recessed speaker mounting assembly comprising:

a mounting frame defining an opening for receiving an audio transducer, the mounting frame including an outer flange around an outer perimeter of the mounting frame;

a plurality of dog fasteners rotationally coupled to the mounting frame; and a dog actuator ring adapted to fit within an inner perimeter of the mounting frame, wherein rotation of the dog actuator ring about a first axis and relative to the mounting frame causes the rotating dog fasteners to rotate about their individual axis distinct from the first axis and secure the mounting frame to a mounting substrate.

2. The recessed speaker mounting assembly of claim 1, wherein the dog actuator ring includes at least one spiral ramp along an external surface, where the spiral ramp engages a pin on the rotating dog fastener.

3. The recessed speaker mounting assembly of claim 2, wherein the spiral ramp extends less than a full turn around the dog actuator ring.

4. The recessed speaker mounting assembly of claim 1, wherein rotating the dog actuator ring in a first direction causes the dog actuator ring to be inserted into the mounting frame and the mounting substrate to be sandwiched between the outer flange and the dog fasteners.

5. The recessed speaker mounting assembly of claim 4, wherein rotating the dog actuator ring in a second direction causes the dog actuator ring to rotate the plurality of dog fasteners and disengage the mounting frame from the mounting substrate.

6. The recessed speaker mounting assembly of claim 1, wherein the dog actuator ring further includes a rotation assist flange on the inner perimeter of the dog actuator ring to facilitate rotation of the dog actuator ring.

7. The recessed speaker mounting assembly of claim 1, further comprising:

a baffle having a plurality of spring-loaded latches to engage the mounting frame, the plurality of spring-loaded latches allowing rotation of the baffle while it is engaged with the mounting frame.

8. The recessed speaker mounting assembly of claim 7, further comprising:

an audio transducer coupled to an inner opening in the baffle; and at least one rotating electrical contact between the baffle and the mounting frame to provide power or audio signals to the audio transducer.

9. The recessed speaker mounting assembly of claim 1, further comprising:

a segment of ratchet teeth along an inner flange of the mounting frame; and a ratchet engagement flange coupled to the dog actuator ring, wherein the ratchet engagement flange engages the ratchet teeth as the dog actuator ring is rotated to prevent the dog actuator ring from disengaging.

10. The recessed speaker mounting assembly of claim 1, further comprising:

a ratchet release lever coupled to the dog actuator ring and adapted to engage the ratchet engagement flange upon depressing of the ratchet release lever to disengage the ratchet teeth.

11. The recessed speaker mounting assembly of claim 1, further comprising:

a wire connection device coupled to the mounting frame, the wire connection device including:

a wire guide to receive an insulated wire;

a base connector to receive the wire guide;

a needle wire penetrator, wherein a first end of the needle wire penetrator is pushed into an end of the insulated wire as the wire guide is inserted into the base connector to create an electrical connection with the wire; and an electrical terminal coupled to a second end of the need e wire penetrator.

12. The recessed speaker mounting assembly of claim 11, wherein the needle wire penetrator is inserted concentric with the insulated wire to create the electrical connection with a conductor in the wire.

13. The recessed speaker mounting assembly of claim 11, further comprising:

a grease pill piston adapted to release grease from a grease pill when the grease pill piston is depressed, wherein the grease flows into a cavity where the needle wire penetrator electrically connects to the wire.

14. A recessed speaker mounting assembly comprising:

a circular mounting frame defining a central opening;

a plurality of fasteners coupled to the mounting frame, where the plurality of fasteners serve to secure the circular mounting frame to a mounting substrate; and an actuator ring adapted to rotate within an inner perimeter of the mounting frame, wherein rotation of the actuator ring about a first axis and relative to the mounting frame causes the plurality of fasteners to rotate about their individual axis distinct from the first axis and secure the mounting frame to the mounting substrate.

15. The recessed speaker mounting assembly of claim 14, wherein the actuator ring includes at least one spiral ramp along an external surface, where the spiral ramp engages the plurality of fasteners to cause the fasteners to secure the mounting frame to the mounting substrate.

16. The recessed speaker mounting assembly of claim 15, wherein the spiral ramp extends less than a full turn around the actuator ring.

17. The recessed speaker mounting assembly of claim 14, further comprising:

a segment of ratchet teeth along an inner flange of the mounting frame; and a ratchet engagement flange coupled to the actuator ring, wherein the ratchet engagement flange engages the ratchet teeth as the actuator ring is rotate to prevent the dog actuator ring from disengaging.

18. The recessed speaker mounting assembly of claim 14, further comprising:

a baffle having a plurality of spring-loaded latches to engage and mounting frame, the plurality of spring-loaded latches allowing rotation of the baffle while it is engaged with the mounting frame; and at least one rotating electrical contact between the baffle and the mounting frame to provide power or audio signals to the audio transducer.

19. The recessed speaker mounting assembly of claim 18, further comprising:

an electrical contact circuit board including at least one electrically conductive ring, where the at least one electrical contact slides against the at least one electrically conductive ring to complete an electrical circuit even when the baffle is rotated while engaged to the mounting frame.

* * * * *